US012203337B2

(12) United States Patent
Tøndel et al.

(10) Patent No.: US 12,203,337 B2
(45) Date of Patent: Jan. 21, 2025

(54) THERMITE REACTION CHARGE, METHOD FOR FORMING A THREEPHASED ROCK-TO-ROCK WELL BARRIER, AND A WELL BARRIER FORMED THEREOF

(71) Applicant: Interwell P&A AS, Hafrsfjord (NO)

(72) Inventors: Stian Tøndel, Trondheim (NO); Darren James Wilkinson, Saksvik (NO); Torgeir Rusten, Vikhammer (NO)

(73) Assignee: INTERWELL P&A AS, Hafrsfjord (NO)

( * ) Notice: Subject to any disclaimer, the term of this patent is extended or adjusted under 35 U.S.C. 154(b) by 0 days.

(21) Appl. No.: 18/011,645

(22) PCT Filed: Jul. 1, 2021

(86) PCT No.: PCT/EP2021/068268
§ 371 (c)(1),
(2) Date: Dec. 20, 2022

(87) PCT Pub. No.: WO2022/008355
PCT Pub. Date: Jan. 13, 2022

(65) Prior Publication Data

US 2023/0258052 A1 Aug. 17, 2023

(30) Foreign Application Priority Data

Jul. 7, 2020 (NO) ..... 20200795

(51) Int. Cl.
*E21B 33/134* (2006.01)
*C06B 33/00* (2006.01)
(Continued)

(52) U.S. Cl.
CPC ..... *E21B 33/134* (2013.01); *C06B 33/00* (2013.01); *C06B 45/12* (2013.01); *E21B 33/1208* (2013.01); *E21B 43/1185* (2013.01)

(58) Field of Classification Search
CPC ..... C06B 33/00; C06B 45/12; E21B 33/1208; E21B 43/1185
See application file for complete search history.

(56) References Cited

U.S. PATENT DOCUMENTS 3,503,814 A * 3/1970 Helms, Jr. ..... C06B 33/00 149/15
7,640,965 B2 1/2010 Bosma et al.
(Continued)

FOREIGN PATENT DOCUMENTS

CN 105624647 6/2016
EP 3 029 261 6/2016
(Continued)

OTHER PUBLICATIONS

Frank M. Mortensen, "A new P&A technology for setting the permanent barriers", Master's Thesis, Master of Science: Petroleum Technology, Drilling, University of Stavanger, 2016.
(Continued)

*Primary Examiner* — Silvana C Runyan
(74) *Attorney, Agent, or Firm* — Wenderoth, Lind & Ponack, L.L.P.

(57) ABSTRACT

This invention relates to a thermite reaction charge comprising bismuth oxide and aluminium adapted to react with a reaction rate giving a reaction time of 8 to 15 seconds for a thermite reaction charge of 30 to 100 kg from initialisation of the thermite reaction charge to at least 90% of the thermite reaction charge is reacted, a method for forming a three-phased rock-to-rock barrier by applying the thermite reaction charge and a well barrier formed thereof.

25 Claims, 14 Drawing Sheets

(51) Int. Cl.

| | |
|---|---|
| ***C06B 45/12*** | (2006.01) |
| ***E21B 33/12*** | (2006.01) |
| ***E21B 43/1185*** | (2006.01) |

(56) References Cited

U.S. PATENT DOCUMENTS

| | | | | |
|---|---|---|---|---|
| 8,298,358 | B1 * | 10/2012 | Coffey | C06B 45/14 149/109.2 |
| 9,494,011 | B1 | 11/2016 | Lowry et al. | |
| 10,254,090 | B1 * | 4/2019 | Mohler | F42B 3/195 |
| 2015/0211326 | A1 | 7/2015 | Lowry et al. | |
| 2015/0368542 | A1 * | 12/2015 | Carragher | C09K 8/426 420/577 |
| 2018/0094504 | A1 | 4/2018 | Hearn et al. | |
| 2019/0032440 | A1 * | 1/2019 | Tøndel | E21B 33/1204 |

FOREIGN PATENT DOCUMENTS

| | | |
|---|---|---|
| EP | 2 857 634 | 7/2019 |
| GB | 2563552 | 9/2019 |
| WO | 2013/135583 | 9/2013 |
| WO | 2017/137226 | 8/2017 |
| WO | 2020/123918 | 6/2020 |

OTHER PUBLICATIONS

A New Approach to Wall Abandonment, Part III, published by Interwell, Jan. 2017.

International Search Report issued Oct. 25, 2021 in International (PCT) Application No. PCT/EP2021/068268.

Search Report issued Feb. 6, 2021 in Norwegian Application No. 20200795, with English translation thereof.

Guerrero, Sergio E. et al., "Combustion of thermite mixtures based on mechanically alloyed aluminum-iodine material", Combustion and Flame, 2010, vol. 164, pp. 164-166.

Wang, L. et al., "The behavior of nanothermite reaction based on Bi2O3/Al", Journal of Applied Physics, vol. 110, No. 7, American Institute of Physics, Oct. 2011, 8 pages.

Excerpt from Khalifeh-Saasen 2020 Book, Introduction to Permanent Plug and Abandonment of Wells, 4 pages.

Special Focus: 2020 Forecast—International Drilling and Production, Feb. 2020, 12 pages.

Chinese Office Action issued Dec. 13, 2023 in corresponding Chinese Patent Application No. 202180047985.1, with English translation.

* cited by examiner b)

a)

THERMITE REACTION CHARGE, METHOD FOR FORMING A THREEPHASED ROCK-TO-ROCK WELL BARRIER, AND A WELL BARRIER FORMED THEREOF

FIELD OF INVENTION

This invention relates to a method and plug for permanent plugging and abandonment of wells into subterranean hydrocarbon reserves.

BACKGROUND

Oil and gas reservoirs are far from empty when ceasing to be commercially viable for the oil and gas industry. Open wells into hydrocarbon reservoirs may therefore leak significant amounts of hydrocarbons over time. As such oil and gas operators are required by governmental regulations to permanently plug their wells into the reservoir when abandoning a field. Around 40 000 oil and gas wells are drilled annually in the world [Ref. 1]. This eventually leads to a vast number of wells in need for permanent plugging before abandonment.

Oil and gas wells are typically drilled in successive sections with a stepwise reduction in the bore diameter for each consecutive section down into the earth. The wellbore is usually filled with drilling mud during drilling. Once a section has been drilled, a steel pipe (often called casing) with a somewhat smaller outer diameter than the bore's inner diameter is inserted all the way down to the bottom of the bore. Then a mixture of cement powder and water (no gravel) is pumped through the casing down to the bottom of the bore and squeezed further into the annulus between the casing and the bore wall to displace drilling mud and set into a solid cement (often denoted as casing cement) sealing off the annulus and make a strong bond between casing and bore. The casing cement may stretch for only a limited distance upwards in the annulus or go all the way to the surface. If the casing cement only stretches a part of the distance, the remaining part of the annulus will typically be filled with drilling mud.

Once a bore section has been completed with casing and cement, the next bore section is drilled with a somewhat lesser diameter than the previous bore, and the same procedure with installing a casing and cement is performed. The second casing typically runs all the way from the well-head to the bottom of the bore leading to a pipe-in-pipe arrangement within the first casing. There may be several consecutive bore sections before reaching the target formation(s) leading to several co-axial pipe-in-pipe casings, each having casing cement such as shown schematically in FIG. 1. The casing cement is shown as the grey shaded areas. In this example it is employed three co-axial casings. An annulus is formed between the casings. It is customary to denote the first annulus between the centre casing and the next casing as the A-annulus, the next annulus the B-annulus etc. For production wells, there is usually a centre located production tubing running from the well-head down to the into the hydrocarbon bearing formation(s). The casing cement should seal off each annulus in the well structure.

A permanent well barrier should extend across the full cross section of the well and sealing all annuli both vertically and horizontally. It is required in several legislations forming at least two well barriers when permanently plugging the well bore. The materials used in the well barrier elements should exhibit a range of properties such as (but not limited to) very low permeability, long-term volume stability, chemical and physical resistance to downhole fluids, non-brittle, and sufficient bonding to the formation.

An initial stage of plugging and abandonment (P&A) operations of wells is thus to assess and determine where to place the plug(s). This assessment takes into consideration the well configuration, depths, inclinations, case strings, casing cements, sidetracks, stratigraphic sequences of the wellbore, and other factors with the aim of finding a suitable place in the well to form the barrier. A key factor is to find a barrier-compatible formation that also possess sufficient cap rock properties [ref. 2, page 19].

PRIOR ART

Portland cement is currently the prime barrier material used in the petroleum industry for zonal isolation and permanent well abandonment. However, Portland cement shrinks somewhat upon setting which may create micro-annuli at the interface between well barrier and formation. There are also concerns related to the brittleness of cement when applied on formations exhibiting creeping, micro-porosity which may give gas migration through the well barrier element, and long-term degradation in high temperatures which persuade engineers to search for alternative materials to Portland cement [Ref. 2, page 110].

One alternative barrier material is metals/alloys. Low-melting metals such as antimony, bismuth and gallium as well as eutectic alloys have been suggested for use in permanent plugging. Of these, bismuth metal and alloys have received special attention. Bismuth is a brittle metal which breaks easily at room temperature, it has a density of 9.78 g/cm$^3$ at 25° C., a melting point of 272° C., boiling point of 1560° C., it expands as it solidifies, and it is fairly resistant to corrosion by being stable to both oxygen and water.

Bismuth-based alloys having low melting points have long been used in the petroleum industry in metal-to-metal seals. There have been two different techniques for placement of bismuth-based alloys; lowering the alloy in the molten state in a container and pour it out at the desired depth or lowering the alloy in the solid state and melt it at the desired depth in the well. The second technique is the most common and carried out in different ways including: heating once downhole using electric resistive or electromagnetic induction, in situ exothermic chemical reaction, or heated steam injection. One of the challenges concerning bismuth-based alloys is the control of vertical heat propagation during installation of the plug when an in situ exothermic reaction is applied. A recent development employs a wireline operation as a bismuth alloy plug placement technique. The plug assembly consists of four main parts: ignition system, alloy jacket, inner tube and skirt. The inner tube, filled with thermite, passes through the bismuth alloy jacket. On ignition, the thermite reaction generates heat and once heated, the bismuth alloy jacket is melted. As the melted bismuth alloy has a high density and its positioning is not maintained, the skirt provides a mechanical support until the bismuth alloy plug cools down and solidifies. Using this method, the radial and vertical heat control is achieved more effectively [Ref. 2, page 127].

Patent documents EP 2 857 634 B1 discloses a mandrel tool intended to be inserted into a tube to be sealed and which forms a plug by melting and solidifying a eutectic alloy carried on circular flanges adapted to cover the cross-sectional area of the annulus formed between the tube to be sealed and the mandrel tool. By forming a bismuth alloy plug sealing off the interior of the tube at a location where the tube has casing cement, the well becomes completely sealed. A similar solution is known from EP 3 029 261 A1. The documents inform that a thermite mixture may be applied as heat source for melting the plug-forming eutectic alloy.

Patent document GB 2 563 552 B discloses use of a dampening agent in a thermite mixture of particulate $Fe_2O_3$ and Al to obtain a more even heating effect for heaters used in down-hole operations. The dampening agent may be present in an amount of to 35 weight % and consists of a binding agent which maintains the solid form during the thermite reaction. The document informs that use of 30 weight % dampening agent may reduce the reaction temperature from about 2500° C. (zero dampening agent) to around 600° C.

It may be required to form a cross-sectional barrier over the entire well bore, also known as a rock-to-rock barrier, in permanent plugging and abandonment making it necessary to gain full access to the formation. The petroleum industry has applied different techniques such as cut-and-pull, casing milling, and section milling to remove tubing, drillpipe and bottomhole assemblies to gain access to the rock formation. Retrieval of such downhole completion exposes personnel to HSE risks, increases the operational time, and carries cost associated with proper handling and disposal of the retrieved equipment [Ref. 2, page 224]. The removal of downhole completion may also require applying a rig to deploy, operate and retrieve the required cutting and/or milling tools.

It is known to apply a thermite to do permanent P&A operations rigless and efficiently by applying a thermite mixture which releases sufficient heat to melt or burn off remaining downhole completion to expose the rock formation.

A thermite is a mixture of an oxide of usually a fine-particulate metal oxide and a (elemental) fuel metal, wherein the metal of the oxide is higher in the electromotive chain than the fuel metal. Upon ignition, an extremely exothermic single-replacement reaction takes place:

$$AO+B \leftrightarrow A+BO+\Delta H$$

Where A and B are metals and B is a "fuel metal" by being above A in the electromotive chain. The heat development during the thermite reaction is usually sufficient to produce metal A and oxide BO in the liquid state. In this concept, a target interval in the wellbore is selected and a thermite mixture is deposited onto a bridge plug or other substrate having been installed in the tubing and then ignited to melt/burn-off all in-situ materials of the downhole completion and usually also some of the surrounding rock formation. Upon cooling, a solidified barrier is created from the in-situ materials and the metal produced by the thermite, as shown in FIG. 2. An example of such solution is known from WO 2013/135583.

Patent document US 2018/0094504 discloses use of nanoscale thermite mixtures for P&A of wells having particle sizes of less than 500 nm, preferably less than 200 nm. The document informs that the use of such fine particulate thermite has the advantage of lower ignition temperatures facilitating the down-hole ignition and that these thermite mixtures exhibit an optimal reaction rate facilitating gas production instead of temperature. The rapid gas evolution increases pressure and rate of burning and thus providing an enhanced heat transfer to the surface of wellbore and casings. This enables using smaller amounts of nano-thermite can be utilized to achieve the same amount of melting as the larger thermite.

Patent document U.S. Pat. No. 9,494,011 B1 discloses sealing wells with an iron oxide and aluminium thermite composition diluted with up to 75 weight % alumina ($Al_2O_3$) to slow the reaction to a rate to a burn rate of less than 1 cm/sec, as compared to a burn rate of 10 to 100 cm/sec for undiluted ferric oxide and aluminium thermite. The slow burn rate reduces the peak reaction temperature to less than 1700° C. (as compared to nearly 3000° C. for undiluted thermite) and reduces the gas formation to very low levels to enable containment of the thermite reaction. It is further disclosed applying a static mass of 500-1500 kg on top of the thermite charge to reduce the porosity of the plug being formed. The document discloses use of two or more thermite charges placed on top of each other where the lowest charge is heavily diluted to only heat the casing to a soft state such that it is pressed against the rock formation, and where the upper thermite charge(s) are less diluted to produce sufficient heat to melt the casing and form a rock-to-rock well barrier.

Patent document U.S. Pat. No. 7,640,965 B2 discloses using an expanding alloy of bismuth, gallium or antimony to seal off the annulus between coaxial tubes by placing an element of the expanding alloy onto a shoulder in the annulus and then apply heat to melt the expanding alloy. The expandable alloy floats out and fills the void and then expands when being solidified and cooled to ambient temperature to form a strong bond and tight sealing of the annulus. A similar solution is applied to seal off the centre tube by first setting a bridge plug of cement or other heat tolerant material and then insert an element of the expandable alloy which is heated until liquid state and then solidified. In one example embodiment, the element of the expandable alloy is a thermite mixture of particulate $Bi_2O_3$ and Al which is ignited and reacted in situ to form a well barrier element of bismuth.

Objective of the Invention

The main objective of the invention is the provision of a rigless method for forming a permanent three-phase rock-to-rock cross-sectional well barrier and the well barrier made by the method.

DESCRIPTION OF THE INVENTION

The invention is based on the realization that by applying a bismuth oxide and fuel metal thermite and adapting the thermite reaction kinetics to a specific parameter window, that the thermite reaction is made to last sufficiently long time and produce sufficient heat energy to effectively melt the casing and adjacent downhole completion over a relatively long interval producing a liquid reaction product and exposing the rock formation to the barrier forming liquid reaction products. The liquid reaction product comprises three immiscible phases; bismuth metal, steel from the casing/downhole completion and a slag phase of alumina and eventual molten casing cement, formation sand etc., which separates due to density differences into a bottom bismuth phase, and intermediate steel phase and a top slag phase. When the system cools, the separated liquid phases solidify to a sandwiched structure of three rock-to-rock well barrier elements. The resulting well barrier structure has the advantage of a relatively long bond zone towards the rock formation, with each phase forming different types of bonding with the rock formation giving the well barrier structure a more resilient bonding.

Thus, in a first aspect, the invention relates to a method of sealing a well with a rock-to-rock cross-sectional well barrier, where the well comprises a downhole completion comprising at least a casing, wherein the method comprises:

installing a heat resistant bridge plug in an innermost casing at a location where the seal is to be formed, placing a thermite charge carrying tool on top of the heat resistant bridge plug, wherein the thermite charge carrying tool comprises an inner chamber filled with a thermite reaction charge and an igniter, and igniting the thermite reaction charge, characterised in that:

the method further comprises applying a thermite reaction charge according to the second aspect of the invention, wherein the thermite reaction charge is pressurised to an in situ pressure of at least 5 MPa.

In a second aspect, the invention relates to a thermite reaction charge, comprising bismuth oxide, $Bi_2O_3$ and a fuel metal comprising aluminium, wherein the thermite reaction charge (7) is adapted to react at a reaction rate giving a reaction time of from 8 to 15 seconds for a thermite reaction charge of 30 to 100 kg from initialisation of the thermite reaction charge to until at least 90% of the thermite reaction charge is reacted, preferably from 9 to 14 seconds, and more preferably from 10 to 13 seconds.

The term "a thermite reaction charge pressurised to an in situ pressure of >5 MPa" as used herein, means that the thermite reaction charge is subject to an ambient pressure of at least 5 MPa when being present at a location in the well where the well barrier is to be formed. The required pressurisation may be obtained by applying a thermite charge carrying tool being pressurised with gas injection or by using piston etc. applying a press on the thermite charge etc., or alternatively by applying a thermite charge carrying tool being pressure aligned with the ambient pressure in the well. The latter may be obtained by e.g. having the piston being subject to the ambient hydrostatic pressure. If the ambient pressure in the well at the location where the barrier is to be formed, the well pressure may be enhanced by injection of gas into the well. Furthermore, the initially produced gases by the thermite reaction may in one alternative be applied to obtain the necessary pressurisation during reaction of the main bulk of the thermite reaction charge.

The term "rock-to-rock cross-sectional well barrier" as used herein means that the well barrier elements are in contact with and bonded to the rock formation and thus blocks the entire cross-sectional area of the well bore.

The term "casing" as used herein means a steel pipe assembled and inserted into a recently drilled section of a borehole to protect and support the flow of fluids. The lower portion (and sometimes the entirety) is typically held in place with cement. There may be sections in the casing structure with two or more co-axial overlapping casing strings separated by an annulus which may be or may not be cemented at the location where the plug is to be formed.

The terms "top", "upper", "lower", and "bottom" as used herein refers to the relative height position within the well.

The term "downhole completion" as used herein comprises at least one casing and casing cement at least sealing a section of the annulus outside of each casing being applied in the downhole completion. If the well to be plugged is a production well, the production tube should be removed beforehand at least in the section where the well barrier is to be formed to enable inserting the thermite carrying tool.

The term "heat resistant bridge plug in the innermost casing" as used herein relates to the need of having a foundation inside the casing to place the thermite charge carrying tool onto and which endures the heat and carries the resulting molten metal/materials from the thermite reaction until they solidify and constitutes the well barrier element(s). The bridge plug should i.e. be able to avoid the molten metal/materials to fall/sink downwards in the innermost casing. The formation of and use of bridge plugs/platforms in thermite-based sealing of wells is well known to the person skilled in the art. The invention may apply any known or conceivable bridge plug/platform. An example of a suited bridge plug is a mechanical bridge plug.

The invention according to the first aspect is drawn schematically in FIGS. 3*a*) to 3*e*). The figures are cut-through views seen from the side illustrating the same segment of a well to be plugged at different stages of the claimed plugging process. FIG. 3*a*) illustrates a section of a well (1) made ready for being plugged and having installed a bridge plug (5). In this example embodiment, the well (1) runs vertically down into a rock formation (2). The downhole completion includes a casing (3) and a casing cement (4). The bridge plug (5) is installed in any conventional manner. With the bridge plug (5) in place the next step is to insert and place a thermite charge carrying tool (6). This is shown in FIG. 3*b*). In this example embodiment, the thermite charge carrying tool (6) is a cylindrical container made of aluminium filled with a thermite charge (7) of particulate bismuth oxide with particle size of 1-3 mm and particulate aluminium with particle size of 1-2 mm. The amount of particulate aluminium is balanced with the amount of aluminium in the container to obtain a stoichiometric ratio, or at least near a stoichiometric ratio of two moles aluminium per mole bismuth oxide. An igniter (8), here a relatively small charge of fine particulate (in the micrometre range) thermite with an electric resistance heating mechanism is located at the lower part of the container, but in certain distance above the bottom/floor to avoid a too rapid melt-through at the bottom of the thermite charge carrying tool (6) creating an "escapeway" for the partly molten and gaseous reaction products. At the upper end of the thermite carrying tool, there is a cable interface (9) or other attachment mechanism for connecting a cable or other means for lowering the thermite charge carrying tool to its intended position. The length/height of the thermite charge, $h_{thermite}$, is indicated in FIG. 3*c*) by the arrows and stapled lines. FIGS. 3*c*) and 3*d*) illustrates the propagating reaction zone (10), FIG. 3*c*) just after ignition and FIG. 3*d*) maybe a few seconds later.

FIG. 3*e*) illustrates the resulting plug after the thermite reaction is completed and the heat has "eaten its way" through by melting the downhole completion, here the casing (3) and the casing cement (4), and allowed the immiscible liquid phases, molten bismuth, molten steel and molten slag to solidify into a first rock-to-rock well barrier element (11) of bismuth, a second rock-to-rock well barrier element (12) of steel, and a third rock-to-rock well barrier element (13) of slag. An advantage of the present invention is that the thermite is adapted due to the pressurization and slowed reaction rate to react at a high temperature, may be as high as around 3000° C. at a sufficiently long endurance to efficiently melt away all of remaining downhole completion at a relatively long section of the well enabling all three materials to form a rock-to-rock well barrier. The length of the bond zone, i.e. the length of the contact area between the rock formation and well barrier elements is indicated on FIG. 3*e*) by the arrows and stapled lines. Another advantage of the invention is that due to the steel and bismuth having fairly dissimilar melting points (steel solidifies first), such that as they solidify sequentially the underlaying bismuth which expands during solidification penetrates into and fills the gap formed between the rock and the steel which previously contracts during solidification. Thus, the combination of solidifying bismuth and steel phases ensures that the second rock-to-rock well barrier of steel obtains an excellent contact with the rock with no or limited leakage routes along the steel/rock interface and a corrosion protection by being "coated" with bismuth penetrating and filling gaps formed between the steel and rock.

Bismuth and aluminium thermite compositions are highly exothermic and potentially highly explosive. Wang et al. [Ref. 3] has studied the impact of nanoscale and microscale Al-particle together with as-synthesised nanoscale $Bi_2O_3$. The mixture produced a pressure discharge of 9 to 13 MPa which was obtained after only 0.01 millisecond with nanoscale Al (particle size 100 nm). This corresponds to a pressurization rate of 3200 GPa/s, which makes the thermite composition to be highly explosive. With 70 μm Al-particles, the pressurization rate was observed to be four orders of magnitude lower, which however, also is in the explosive range. Another issue is that fine powdered bismuth and aluminium thermite mixtures are sensitive and may relatively easy be ignited by e.g. a static electricity discharge. Fine powdered bismuth and aluminium are thus classified as high explosive materials inducing extensive safety measures during storing, transport and handling.

The explosive nature of fine powdered bismuth oxide and aluminium thermites makes them less suited for the present purpose. It is observed that the thermite reaction when using microscale or nanoscale thermite mixtures is too violent and explosive in nature leading to failure of forming the intended three-phased rock-to-rock well barrier, probably due to excessive volatile gas production and spreading of the reactant products and.

It is observed that a slower thermite reaction rate, as compared to the fine powdered thermite mixture, functions much better and will together with the effect of the pressurisation to at least 5 MPa form the intended three-phased rock-to-rock well barrier. I.e., the intended well barrier is observed obtained when the reaction kinetics are tuned such that a thermite reaction charge of 30 to 100 kg is almost completely reacted within 8 to 15 seconds after ignition. The experiments made by the applicant indicate that such time window seems to be the necessary balance between the need for relatively hefty heat production to obtain the necessary sensible heat to eat away the completion and the need for confining the reaction products and heat being developed.

Chemical reaction rates typically increase exponentially with temperature. The thermite reaction is no exception. Without being bound by theory, it is believed that the rapid temperature increase during the thermite reaction causes a strong exponential growth in the reaction rate such that it is the initial face of the reaction, with relatively much slower reaction kinetics than the later stages, which dominates the time it takes to react a mass of thermite. Whatever the cause may be, it is observed that comparatively amounts of similar (same particle sizes, composition, compactness etc.) thermite reaction charges need approx. the same time to react almost completely and give an observable decrease in the pressure at of reaction zone. The amount of similar $Bi_2O_3$ and Al thermite reaction charges being applied to form the three-phased rock-to-rock well barrier will typically be in the range from 30 to 100 kg. Experiments made by the applicant with similar $Bi_2O_3$ and Al thermite reaction charges according to the second aspect of the invention in an amount of 38.5, 70 and 90 kg showed a reaction time of 13, 12 and 10 seconds, respectively when reacted in plugging tests where the thermite was pressurised to 150 bars before ignition. The test results are displayed graphically in FIG. 6. As seen on the figure, the pressure development shows an initial period of approx. 7-8 seconds with a slow pressure build-up before a strong and rapid build-up is observed to reach a top at approx. 10-13 seconds before falling somewhat again when the termite reaction loses moment due to little reactants left to feed the reaction. It is believed that at the observed pressure top, at least 90% of the thermite charge has reacted and been converted to reaction products. Thus, the term "reaction time" as used herein refers to the time span from the initialisation of the thermite reaction, when the reaction is taking place within a well barrier forming tool pressurised to at least 5 MPa, until the major part (at least 90%) of the thermite reaction charge has been reacted and the pressure begins to drop. The reaction time may preferably be from 8 to 15 seconds, preferably from 9 to 14, and more preferably from 10 to 13 seconds.

The feature of pressurising the thermite reaction charge to a pressure of at least 5 MPa (50 bar) before ignition of the thermite reaction mixture creates a substantial boiling point elevation of the bismuth being produced in the thermite reaction. This has the effect of decreasing the amount of bismuth evaporating and to raise the temperature of both the liquid bismuth pool and the bismuth vapour being formed with several hundred degrees above the normal boiling point of 1564° C. Without being bound by theory, it is believed that it is the relatively high sensible heat of the pressurised bismuth-rich reaction product, with all its constituent liquid and gaseous states, which manages to supply sufficient heat to effectively melt all adjacent downhole completion. The relatively high sensible heat is believed to be a result of the boiling point elevation caused by the pressurisation providing both a relatively hot liquid phase and similarly hot (and dense) gaseous phase providing release of ample amounts of latent heat upon condensation giving a relatively long "heating plateau" around the elevated condensation/boiling temperature of Bi. It is observed experimentally that if the pressure becomes significantly below 5 MPa, and/or the thermite reaction proceeds at significantly faster or slower reaction rates than the optimum, that the sandwiched structure of three rock-to-rock well barrier elements fails to form. Either by the reaction products being "blown away" (upwards in the well) or by inadequate melting of the downhole completion to enable forming the three-phased rock-to-rock well barrier. Thus, the initial pressure should be at least 5 MPa, preferably at least 6 MPa, more preferably at least 8 MPa, more preferably at least 10 MPa, and most preferably at least 12 MPa. The invention may apply any known or conceivable way of pressurising the thermite reaction charge. Examples of suited methods comprises use of a piston, injection of a gas, etc. If the well barrier is to be made in liquid-filled wells at depths having hydrostatic pressures above 5 MPa, the pressurisation of the thermite reaction charge may be aligned to the hydrostatic pressure at the intended depth.

As given above, it is believed that it is the combination of pressurised reaction which significantly increases the temperature of the liquid metal being formed above its normal (at one atmosphere) boiling point and the relative slow reaction rate (as compared to the usually fine grained bismuth oxide and aluminium thermite charges) which enables effectively melting away all of the downhole completion being present in the well over a sufficient depth interval to form the three-phased rock-to-rock barrier. The bismuth oxide and aluminium thermite charge should thus be adapted to react suitably slower than the most commonly applied thermite charges.

The adaption of thermite reaction charge to slow the reaction rate may be obtained in several ways known to the skilled person. The invention may apply any solution known to the person skilled in the art to adapt the thermite reaction charge to obtain the desired reaction kinetics. An example is to adapt the thermite reaction charge by adding a non-reactive component, typically one or more of the product compounds being formed by the thermite reaction. I.e. one or both of Al and $Bi_2O_3$. A further example is to coat the bismuth oxide and or the aluminium particles with a coating, such as silicone elastomers, water glass. The adaption may also be obtained by increasing the particle size of the bismuth oxide and/or aluminium. It is within the normal skills of a person skilled in the art to adapt a thermite mixture by e.g. trial and error tests to arrive at a bismuth oxide and aluminium thermite mixture which reacts at a reaction rate giving a reaction time of from 8 to 15 seconds for a thermite reaction charge of 30 to 100 kg from initialisation of the thermite reaction charge to until at least 90% of the thermite reaction charge is reacted.

Experiments made by the inventors have found that increasing the particle sizes of the bismuth oxide and the aluminium particles reduces the thermite reaction rate. However, it has surprisingly turned out that increasing the particle size above 1-3 mm of the $Bi_2O_3$-particles and 1-2 mm of the Al-particles does not significantly affect the burn velocity any further. The particle size effect on the reaction rate seems to level off at a certain particle size and from thereon remain relatively constant with increasing particle sizes. The experimental results made by the inventors indicate that there is no limit to the upper size of the bismuth oxide and aluminium particles which may be made to react and maintain a thermite reaction at the intended burn rate as long as the ambient pressure is at least 5 MPa and there is sufficient contact area between the reactants. However, larger particles pack less of the available space in the inner chamber than smaller particles. Thus, in one example embodiment, the adaption of the thermite reaction charge may be obtained by the thermite reaction charge comprising particulate bismuth oxide of particle size in the range of from 1 mm to 1 cm and particulate aluminium of particle size in the range of from 1 mm to 1 cm, preferably particulate bismuth oxide of particle size in the range of from 1 to 7 mm and particulate aluminium of particle size in the range of from 1 to 7 mm, more preferably particulate bismuth oxide of particle size in the range of from 1 to 5 mm and particulate aluminium of particle size in the range of from 1 to 5 mm, more preferably particulate bismuth oxide of particle size in the range of from 1 to 3 mm and particulate aluminium of particle size in the range of from 1 to 3 mm, and most preferably particulate bismuth oxide of particle size in the range of from 1 to 3 mm and particulate aluminium of particle size in the range of from 1 to 2 mm. It is observed experimentally that such relatively large particle sizes of the bismuth oxide and/or the aluminium provides a suitable thermite reaction kinetics corresponding to reaction time of from 8 to 15 s for a thermite reaction charge of 30 to 100 kg.

The particle sizes as used herein is the diameter of the particle as determined by standard ISO 9276-1:1998 for irregular particles based on the volume of the particle. I.e. the diameter of the particle is determined as being considered equal to the diameter of a sphere having the same volume as the irregular particle. In the practical life, it is inevitable that some amount of smaller or larger particles than the intended size is present in the particulate material. The term "particle size" as used herein is thus the diameter of the particle as determined by standard ISO 9276-1:1998 given for the median particle size (d50) as determined by ISO 9276-2:2001.

In another example embodiment, the adaption of the thermite charge according to the second aspect of the invention may be obtained by the thermite charge comprising at least one monolithic disc of pressed particulate bismuth oxide and at least one monolithic object of solid aluminium. The discs of bismuth oxide may advantageously have an outer diameter slightly less, by e.g. 1-10 mm, than the inner diameter of an inner chamber of a thermite charge carrying tool intended to bring the thermite charge to the well barrier forming position to effectively pack the available space of the thermite carrying tool's chamber with the thermite charge. I.e., the diameter of the pressed bismuth oxide discs will be approximately 1-3 cm less than the inner diameter of the innermost casing. The monolithic discs of bismuth oxide may be made by isostatic pressing of bismuth oxide particles to a solid disc of density in the range of from 50 to 99%, preferably of from 55 to 95%, more preferably of from 60 to 90%, more of from 65 to 85%, and most preferably of from 70 to 80% of the theoretical maximum density of 8.9 g/cm$^3$. The thickness of the bismuth oxide discs may be in the range of from 0.5 to 20 cm, preferably of from 1 to 17.5 cm, more preferably of from 1.5 to 15 cm, more preferably of from 2 to 12.5 cm, and most probably of from 3 to 10 cm.

The at least one monolithic object of aluminium may in one embodiment be a planar circular disc having a similar diameter as the applied disc(s) of pressed bismuth oxide to enable forming an even interdigitated stack of alternating bismuth oxide and aluminium discs. The aluminium discs may advantageously have the same diameter as the bismuth oxide discs and a thickness adapted to provide a stoichiometric ratio with the bismuth oxide discs. Typically, the thickness of the aluminium discs will be in the range of from 10 to 25% of the bismuth oxide disc thickness, depending on the density of the pressed bismuth oxide disc. If the thermite charge carrying tool contains aluminium which comes in contact with the bismuth oxide, this aluminium content may also be made part of the stoichiometric balance, thus influencing (reducing) the thickness of the aluminium discs.

A great advantage of applying a thermite charge comprising solid monolithic objects of pressed bismuth oxide and aluminium metal, is that the thermite charge is insensitive towards mechanical shocks, heating up to several hundred degrees, and/or static electric discharges and have thus very little to no risk of being accidentally ignited. This embodiment enables easily storing and transporting the monolithic objects of bismuth oxide and the monolithic objects of aluminium separately and then assemble the thermite reaction charge on site by e.g. making a stack of alternating discs of pressed bismuth oxide and discs of aluminium adapted to fit and cover the cross-sectional of an inner cylindrical chamber of a thermite carrying tool, as indicated schematically in FIG. 4.

FIG. 4 is a cut-view as seen from the side of a thermite charge carrying tool (6) comprising a cylindrically shaped aluminium container having a bottom (15), a side-wall (16) and top (17), an inner cylindrical chamber (18), a cable interface (9) at the top, a gas inlet/outlet (19) with a combined check and release valve (20) being adapted to allow gas being injected through inlet/outlet (19) and prevent the gas from flowing out as long as the gas pressure inside the chamber is less than a pre-set gas pressure increase, Δp. The inner chamber (18) is almost completely filled by a stack of alternating monolithic bismuth oxide discs (21) and monolithic aluminium discs (22). The discs (21, 22) has diameter slightly less, e.g. of 1 to 5 mm, preferably of 1.5 to 3 mm, more preferably of 1.5 to 2.5 mm, and most preferably of 2 mm, than the inner diameter of the cylindrical inner chamber (18) such that the stack fills almost all available space of the inner chamber. The thickness of the monolithic bismuth oxide discs (21) may typically be in the range of from 1 to 10 cm, preferably of from 2 to 8 cm, more preferably of from 2.5 to 6 cm, and most preferably of from 3 to 5 cm. The thickness of the monolithic aluminium discs may be adapted in accordance with the thickness of the bismuth oxide discs to give a stoichiometric ratio of bismuth oxide and aluminium including the aluminium content of the bottom (15), a side-wall (16) and top (17) of the inner cylindrical chamber (18). A remotely controlled igniter (8) is incorporated into one monolithic bismuth oxide disc being adapted to heat the ambient bismuth oxide and aluminium to set-off the thermite reaction.

In one example embodiment, the thermite reaction charge may be adapted by the thermite reaction comprising discs (30) of pressed bismuth oxide powder pressed to the same density and having similar (outer) diameter and thickness as given above but where the discs has a through-going centre channel (31) located at and in parallel with the disc's rotational symmetry axis. By stacking two or more of these discs, a vertically oriented centre channel going through the entire stack will be formed as shown schematically in FIG. 5*a*). The figure is an exploded view of two discs (30) as seen from the side and above. The rotational symmetry axis is indicated by the stapled line marked A and A'. In this embodiment, there is no need for aluminium discs in the stack. The aluminium may instead be provided in the centre channel (31). The diameter of the centre channel may advantageously be adapted accommodate sufficient space to give room for housing a stoichiometric amount of aluminium. An advantage of this solution is that the thermite reaction is ignited and triggered at the centre of the bulk mass of the thermite reaction charge such that the thermite charge carrying tool receives less heat strain at the early stage of the reaction and thus maintain the mechanical integrity somewhat longer before being destroyed by the superhot reaction products. This gives a more even heating and melting effect along the height of the thermite charge carrying tool alleviating an effective melting of the downhole completion.

The adaption of the thermite reaction charge may in one example embodiment further comprise adding slag forming compounds which obtain a slag phase after reaction having a melting point between 1800 and 1200° C., preferably between 1700 and 1200° C., more preferably between 1600 and 1200° C., more preferably between 1500 and 1200° C., and most preferably between 1400 and 1200° C. It is observed in tests that if the slag phase has a melting point significantly above 1800° C., there may in the early stage of the well barrier formation be formed a solidified phase of slag on the inside of the casing acting as a heat shield preventing the steel tube from melting completely over the entire intended length. The adaption of the slag phase may be obtained by e.g. partial or complete replacement of the Al fuel with Ca, Mg and/or Si based fuels. The degree of replacement of Al fuel may advantageously be in the range of from 1 to 32 wt % Mg and from 1 to 68 wt % $CaSi_2$, preferably of from 5 to 32 wt % Mg and from 10 to 68 wt % $CaSi_2$, more preferably of from 10 to 32 wt % Mg and from 20 to 68 wt % $CaSi_2$, and most preferably of from 15 to 32 wt % Mg and from 30 to 68 wt % $CaSi_2$. The wt % is based on total weight of the fuel metals, i.e. the sum of Al, Mg, Si and Ca present in the thermite charge. The most applied casing cement is Portland cement which mainly comprises dicalcium silicates and tricalcium silicates, $(CaO)_2 \cdot SiO_2$ and $(CaO)_3 \cdot SiO_2$, respectively. In an example embodiment, the adaption of the composition of the slag being formed may advantageously be balanced in view of expected amount of casing cement going to be melted and become part of the molten slag phase subsequently being solidified into the third rock-to-rock well barrier element. Alternatively, the adaption of the slag composition may be obtained by adding CaO, MgO, $SiO_2$ or mixtures thereof to the thermite charge. This will have the combined effect of reducing the thermite reaction kinetics by dilution by an inert material and to lower the melting point of the resulting slag phase. The amount of added CaO, MgO, $SiO_2$ or mixtures thereof may preferably be adapted to provide, after reacting the thermite charge, a slag phase having a melting point between 1800 and 1200° C., preferably between 1700 and 1200° C., more preferably between 1600 and 1200° C., more preferably between 1500 and 1200° C., and most preferably between 1400 and 1200° C.

In a third aspect, the invention relates to a thermite charge carrying tool (6), where the thermite charge carrying tool comprises a cylindrically shaped container having

- a bottom (15),
- a side-wall (16)
- a top (17),
- a cylindrical inner chamber (18), and
- a cable interface (9) on the top (17), wherein the thermite charge carrying tool (6) further comprises:

- a thermite reaction charge (7) according to the second aspect of the invention located in the inner chamber (18), and
- an igniter (8) adapted to ignite the thermite reaction charge (7).

The container of the thermite charge carrying tool may advantageously be made of a known thermite fuel metal or a steel or a combination of both. Examples of fuel metals include aluminium, magnesium, zinc, copper.

In one embodiment, the thermite charge carrying tool further comprises a piston located in the inner chamber adapted to press against the thermite reaction charge (7) therein. The piston may be actuated by an actuator connected to the piston, by the gravitational pull on a weight located above the piston, etc.

In one aspect, the thermite charge carrying tool may further comprise a check valve (20) located in the gas inlet/outlet (19), wherein the check valve (20) is adapted to enable injecting gas to obtain and maintain an initial gas pressure $p_i$ of at least 5 MPa, preferably of at least 6 MPa, more preferably at least 8 MPa, more preferably at least 10 MPa, and most preferably at least 12 MPa. In a further aspect, the valve (20) may be a combined check and release valve adapted to enable injecting gas to obtain and maintain an initial gas pressure $p_i$ of at least 5 MPa, preferably of at least 6 MPa, more preferably at least 8 MPa, more preferably at least 10 MPa, and most preferably at least 12 MPa, and further to open and release gas if the gas pressure p inside chamber (18) becomes; $p > p_i + \Delta p$, where Δp is 0.1 MPa, preferably 0.15 MPa, more preferably be 0.2 MPa, more preferably 0.3 MPa, more preferably 0.5 MPa, and most preferably 1 MPa.

FIG. 5*b*) is a drawing schematically illustrating an example embodiment of a thermite charge carrying tool loaded with a stack of these discs (30) and where the aluminium is supplied as a rod (32) adapted fit into and fill the vertical centre channel formed by aligned centre holes. It may advantageously be applied two aluminium rods (32) adapted to together with an igniter (8) fill the entire length of the vertical centre channel (31).

The function of the thermite charge carrying tool is mainly to be a transport tool which carries and places the thermite reaction charge to a position down into the innermost casing where the well barrier is to be established and a pressure control device, and further to act as mechanical support containing the thermite reaction mixture and ensuring a sufficiently high gas pressure in the initial reaction phase (until the tool melts/is burned through). The invention may apply any known or conceivable thermite charge carrying tool as long as it has an inner chamber able to contain the thermite reaction mass under an (initial) gas pressure of at least 5 MPa.

An example embodiment of a thermite charge carrying tool is an elongated tubular metallic container of either steel or aluminium being closed in both ends. The thermite charge carrying tool is in its upper end attached to a hoisting mechanism which inserts and lowers the thermite charge carrying tool to its intended position inside the innermost casing and will typically have the igniter located at the opposite lower end. If the thermite charge carrying tool is made of aluminium, the walls of the inner container will be reactive towards the bismuth oxide and contribute in the thermite reaction. In this example embodiment, it may be advantageous to include the mass of the container walls in the thermite composition, i.e. reducing the amount of particulate aluminium accordingly to obtain a stoichiometric thermite composition by accounting for both the Al-particles and Al in the walls of the tool.

In one example embodiment, the thermite charge carrying tool comprises a pressure relief valve set to open and release gas if the gas pressure inside the container increases above an intended gas pressure increase, i.e. if: $p>p_i+\Delta p$, where p is the gas pressure inside the container, $p_i$ is the initial gas pressure inside the container before ignition, and $\Delta p$ is the intended gas increase. The pressure relief valve reduces the driving force (gas pressure increase) which acts to squeeze molten material up the outside of the remaining thermite charge carrying tool after melting/burn-through. The pressure increase, $\Delta p$, at which the pressure release valve may be set to open may be 0.1 MPa, preferably 0.15 MPa, more preferably be 0.2 MPa, more preferably 0.3 MPa, more preferably 0.5 MPa, and most preferably 1 MPa.

Common to all permanent plugging of wells is to identify a suitable location in the well where to place the well barrier. This assessment takes into consideration the well configuration, depths, inclinations, case strings, casing cements, sidetracks, stratigraphic sequences of the wellbore, and other factors with the aim of finding a suitable place in the well to form the plug. A key factor is to find a geologically appropriate formation interval. A suitable formation should possess sufficient cap rock properties along the expected length of the barrier [ref. 2, page 19]. Even though the location of where to place the well barrier is a vital step for a successful plugging, this is no part of the present invention because assessing where to place the plug is common to any plugging process and are well known to the person skilled in the art, and further because the present invention relates to how to make the well barrier and its structure. In one example embodiment, the determination of where to locate the well barrier may advantageously take into consideration that the casing(s) may advantageously have a cement casing. This feature will make casing cement not being melted to seal the annulus below the desired location of where to form the well barrier and thus prevent liquid metal and/or slag formed by the thermite reaction from flowing downwards in the annulus after melting through the casing and solidify below the desired location of where to form the well barrier.

In a fourth aspect, the invention relates to a rock-to-rock cross-sectional well barrier in a well bore, where the well bore comprises a downhole completion comprising at least a casing, and wherein the rock-to-rock cross-sectional well barrier comprises:

- a first rock-to-rock well barrier element (11) of bismuth,
- a second rock-to-rock well barrier element (12) of steel on top of the first well barrier element (11), and
- a third rock-to-rock well barrier element (13) of slag on top of the second well barrier element (12).

The rock-to-rock cross-sectional well barrier may be made the method according to the first aspect of the invention applying a thermite charge according to the third aspect of the invention.

LIST OF FIGURES

Figure 1:
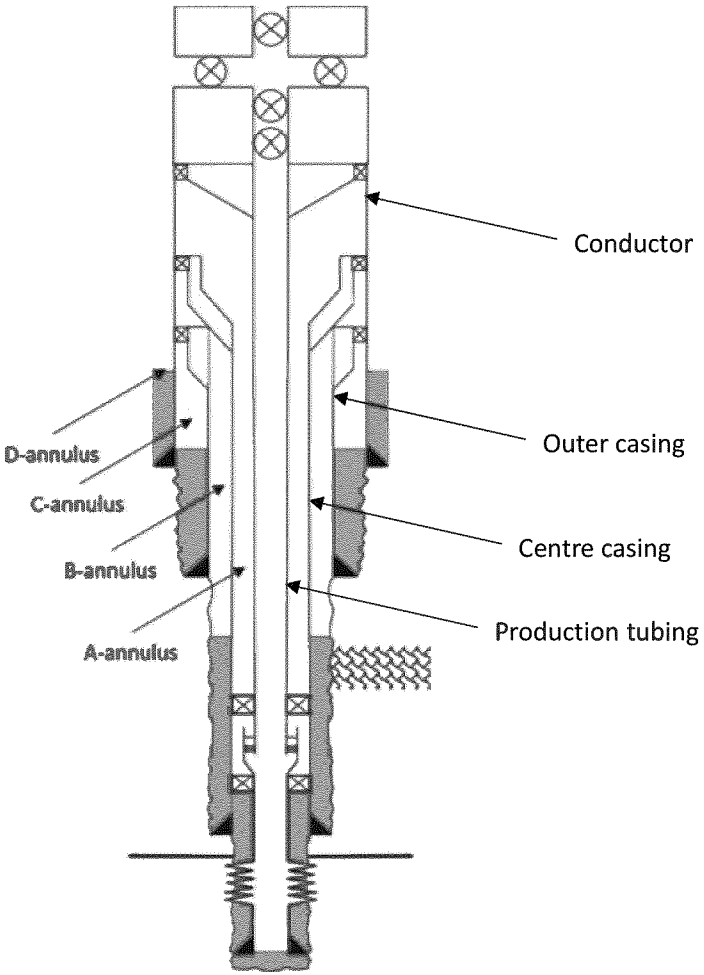
FIG. 1 is a facsimile of FIG. 2.2 of [Ref. 2] showing a typical construction of a well including downhole completion.
Figure 2:
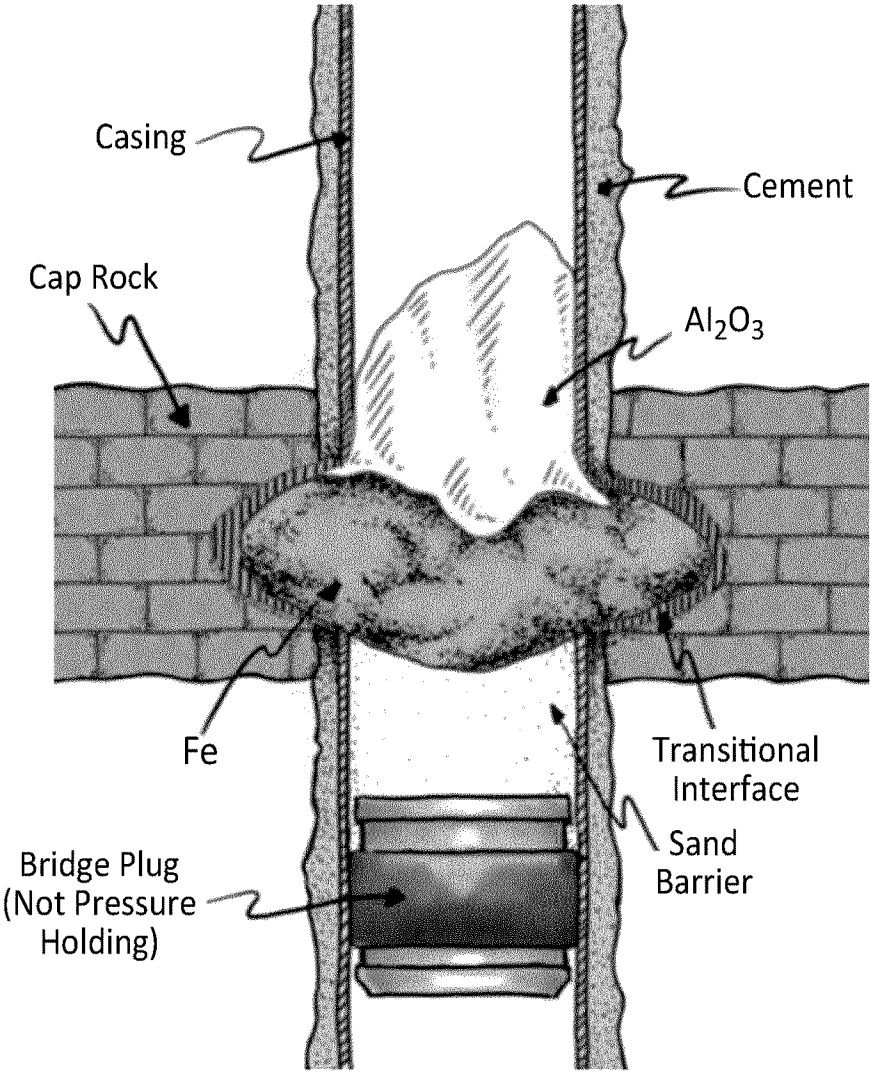
FIG. 2 is a facsimile of FIG. 4.21 of [Ref. 2] showing a drawing of the structure of a permanent rock-to-rock well barrier according to prior art made by an iron oxide and aluminium thermite.
Figure 3:
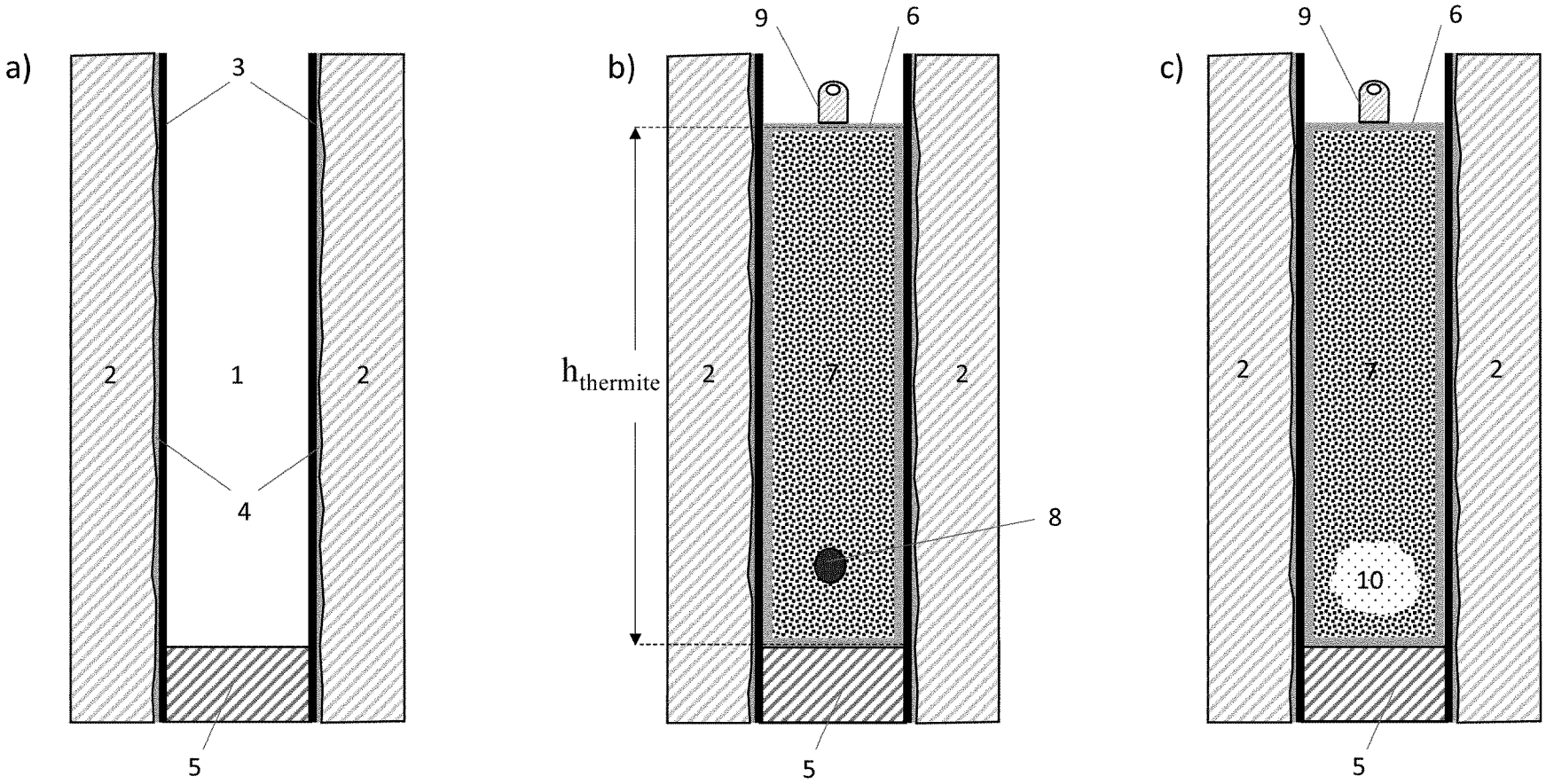
Figure 3:
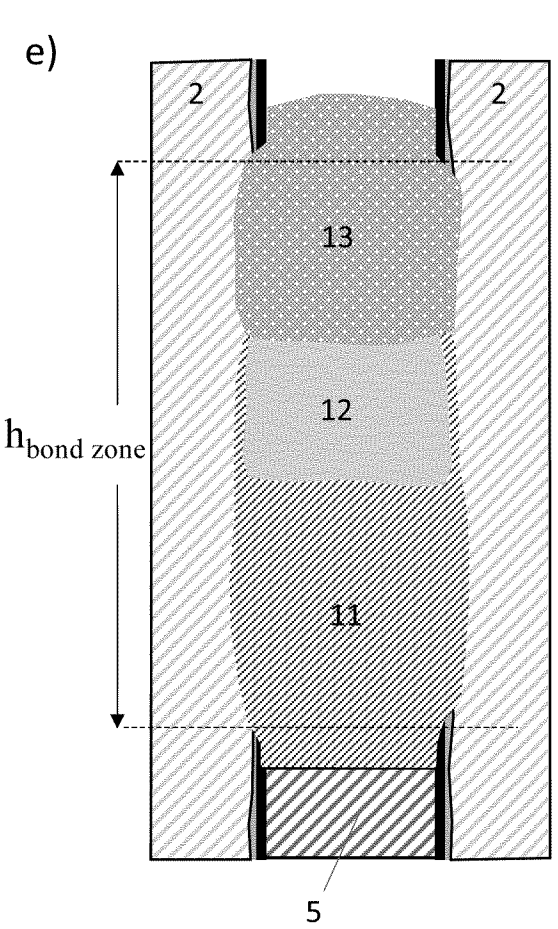
Figure 3:
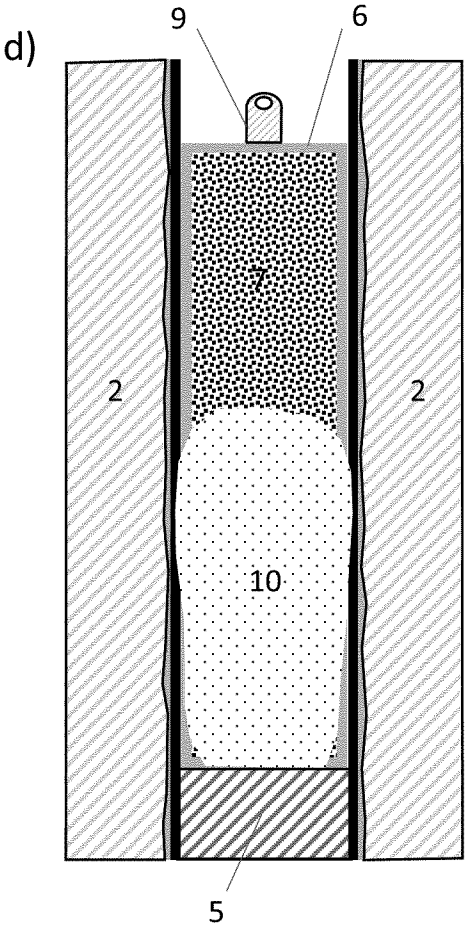

FIGS. 3*a*) to 3*e*) are drawings seen from the side schematically illustrating the method of forming a permanent rock-to-rock well barrier according to the present invention.

Figure 4:
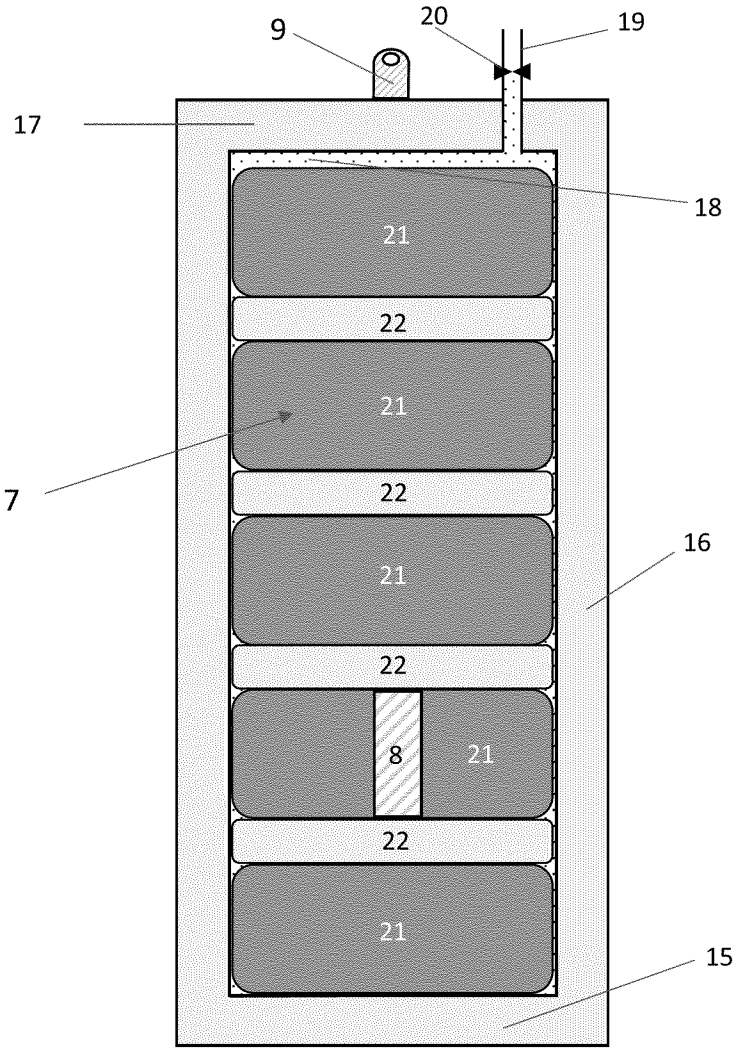

FIG. 4 is a drawing as seen from the side illustrating an example embodiment of a thermite charge carrying tool containing an example embodiment of a thermite charge according to the invention.

Figure 5:
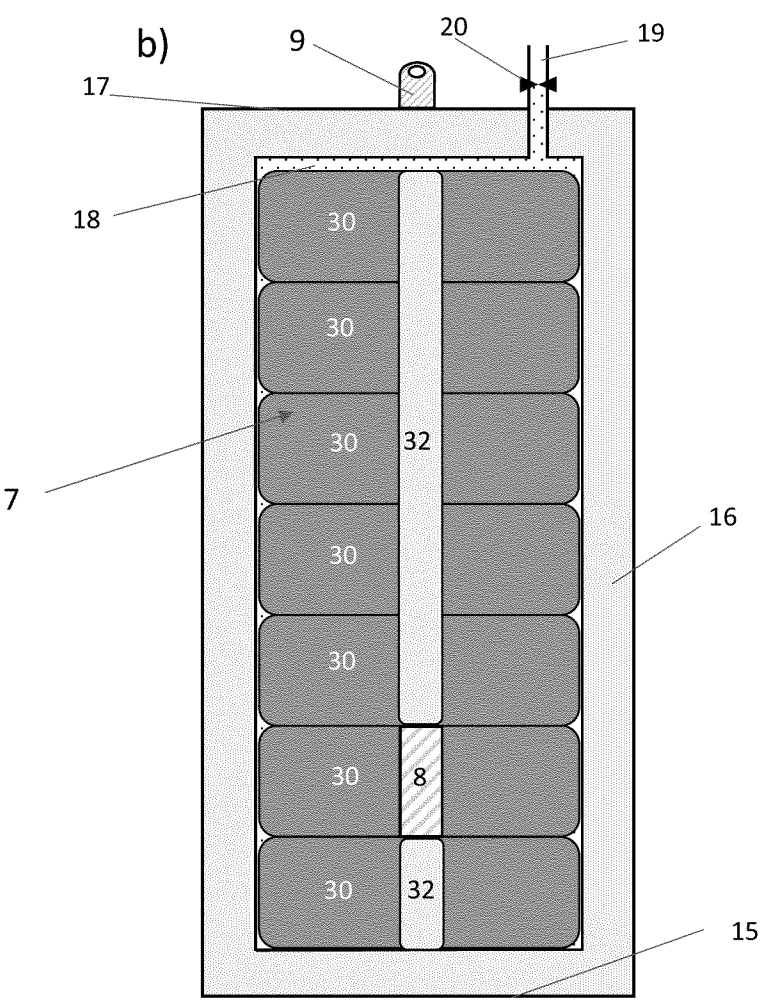
Figure 5:
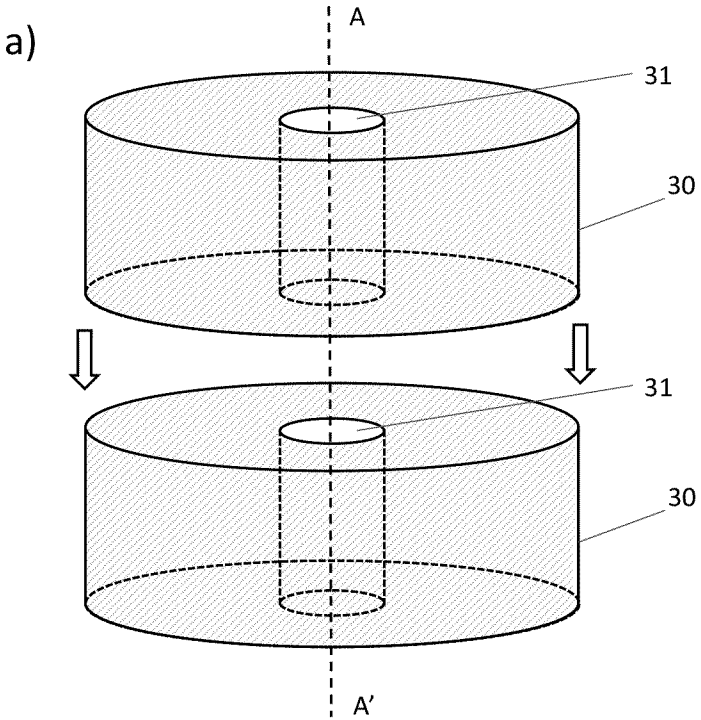

FIG. 5*a*) is drawing as seen from the side and above illustrating an exploded view of an example embodiment of discs made of bismuth oxide to be applied in another example embodiment of a thermite charge according to the invention.

FIG. 5*b*) is drawing as seen from the side of a thermite charge carrying tool loaded with a thermite reaction charge applying the discs shown in FIG. 5*a*).

Figure 6:
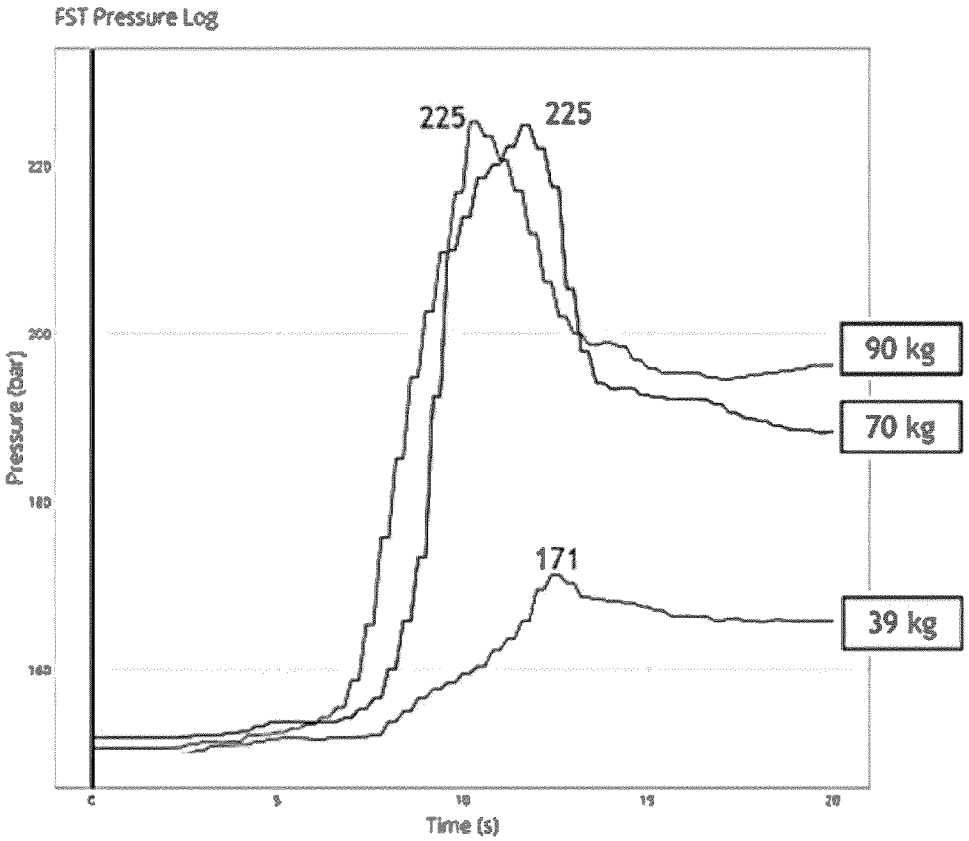

FIG. 6 is a diagram showing measured pressure development in three full-scale tests of the thermite reaction charges according to the second aspect of the invention.

Figure 7:
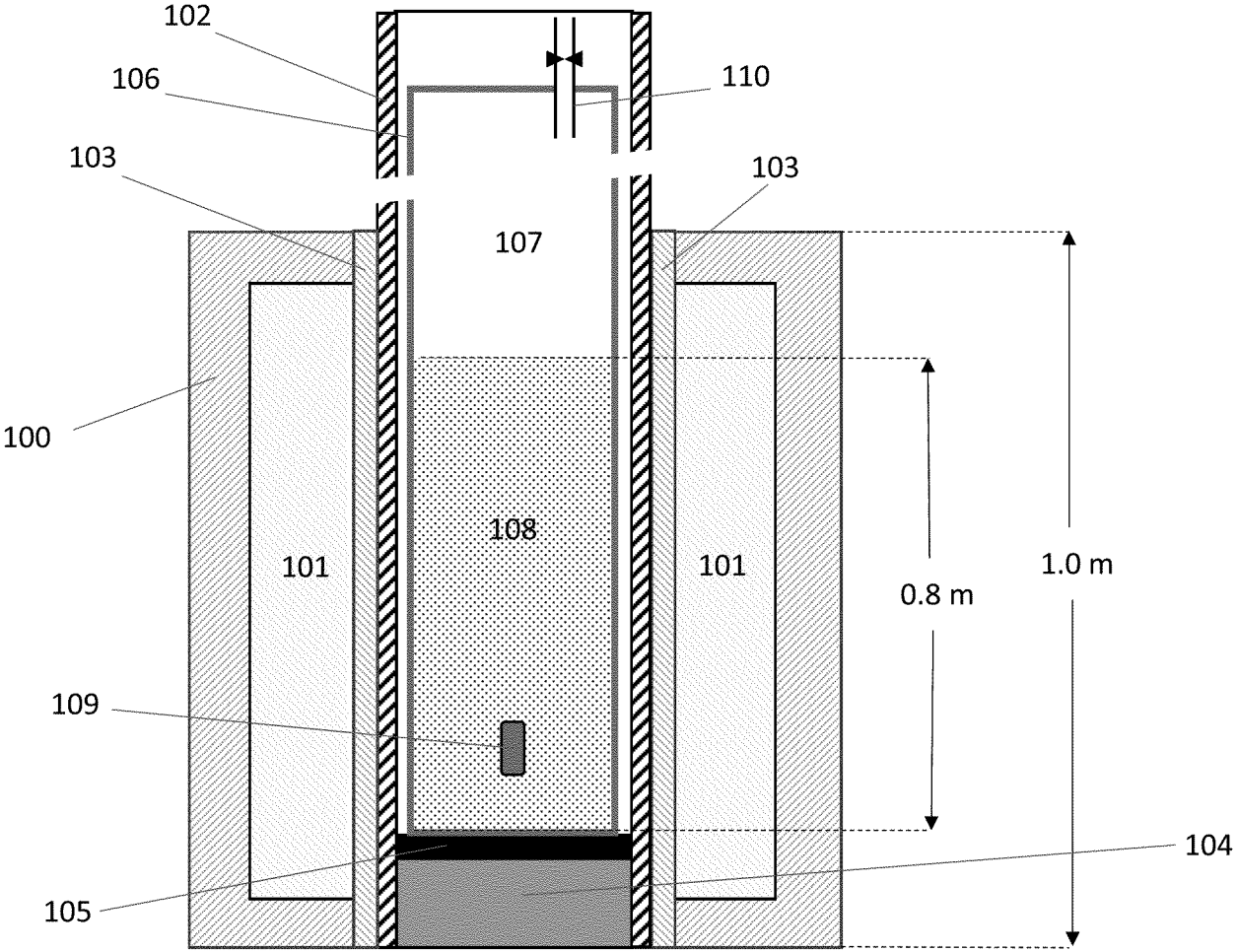

FIG. 7 is a drawing showing the construction of a test tool applied to test the barrier forming ability of the thermite reaction charges according to the second aspect of the invention.

FIGS. 8 to 11 show photographs showing resulting three-phased rock-to-rock well barriers being made in tests applying thermite reaction charges according to the second aspect of the invention.

Figure 12:
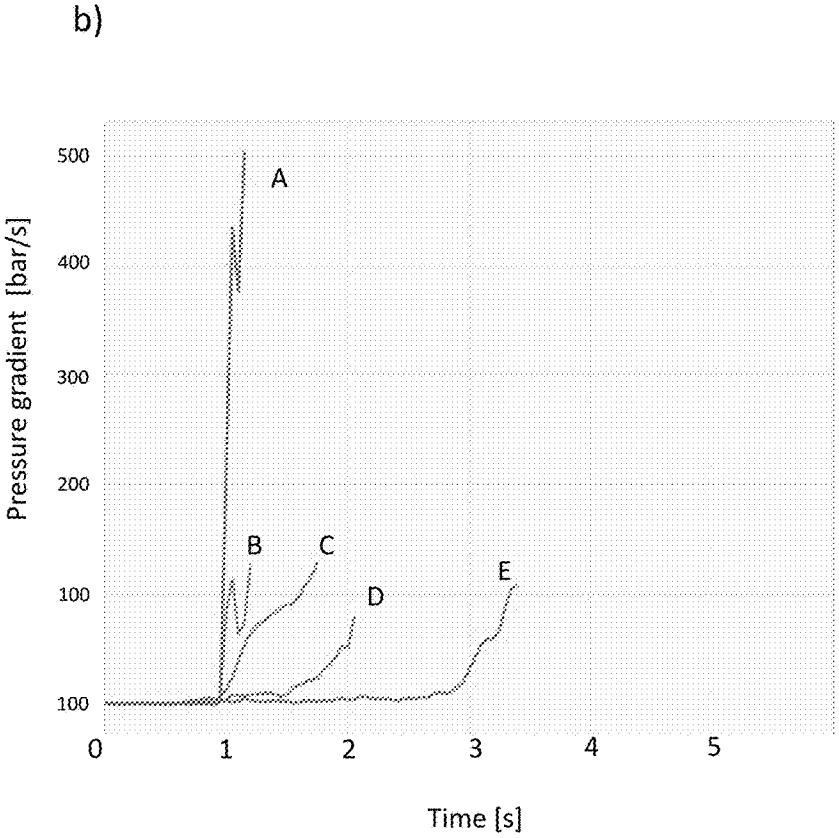
Figure 12:
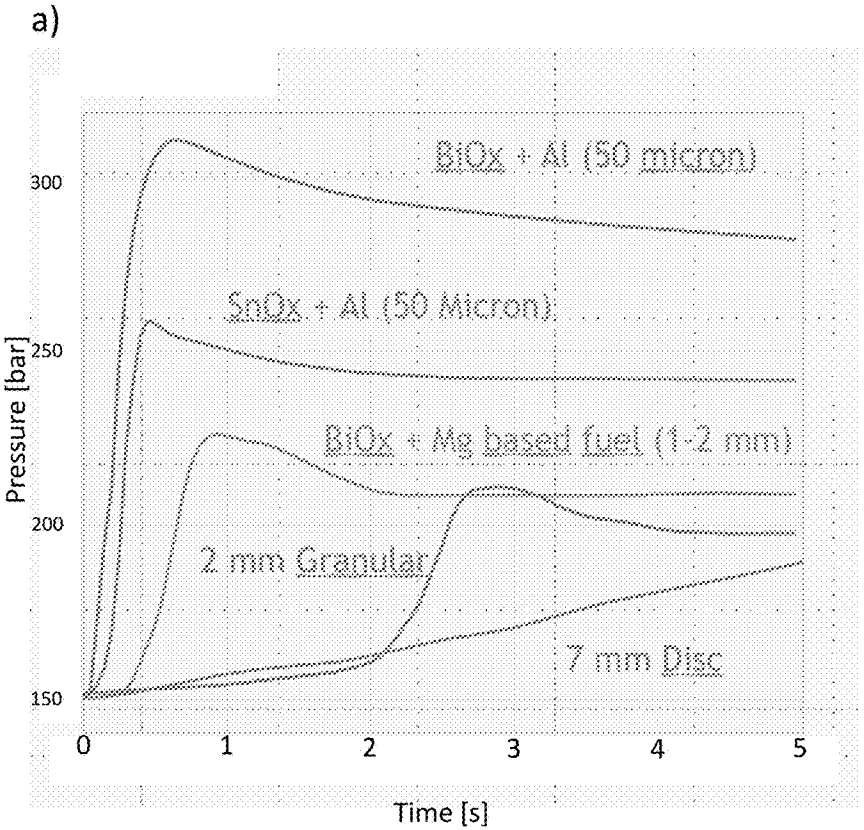

FIGS. 12*a*) and 12*b*) are diagrams showing measured pressures versus time (12*a*)) and measured temperature gradients versus time (12*b*)) in comparison tests.

Figure 13:
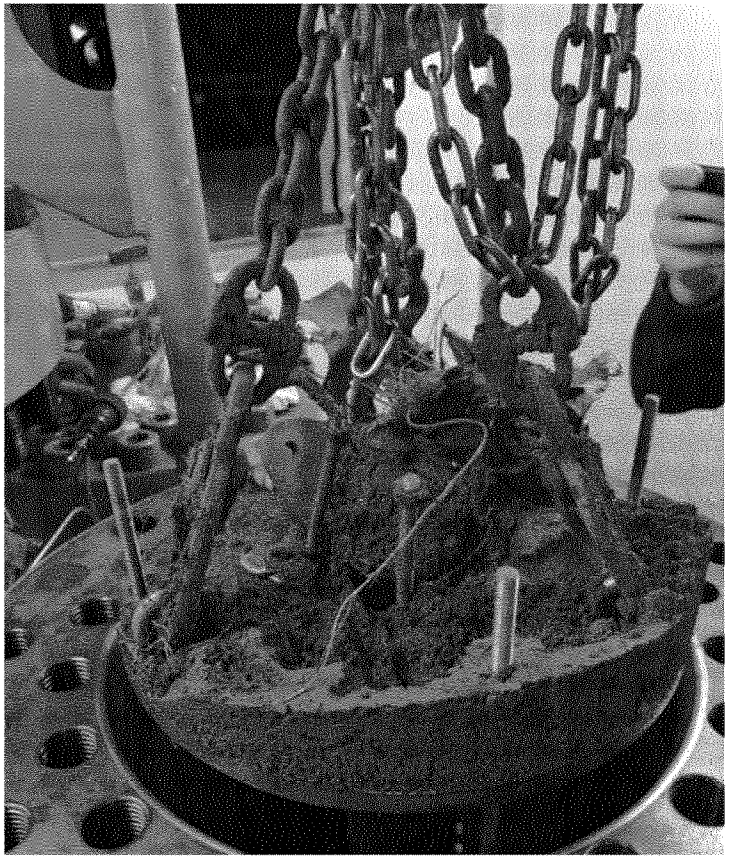
Figure 13:
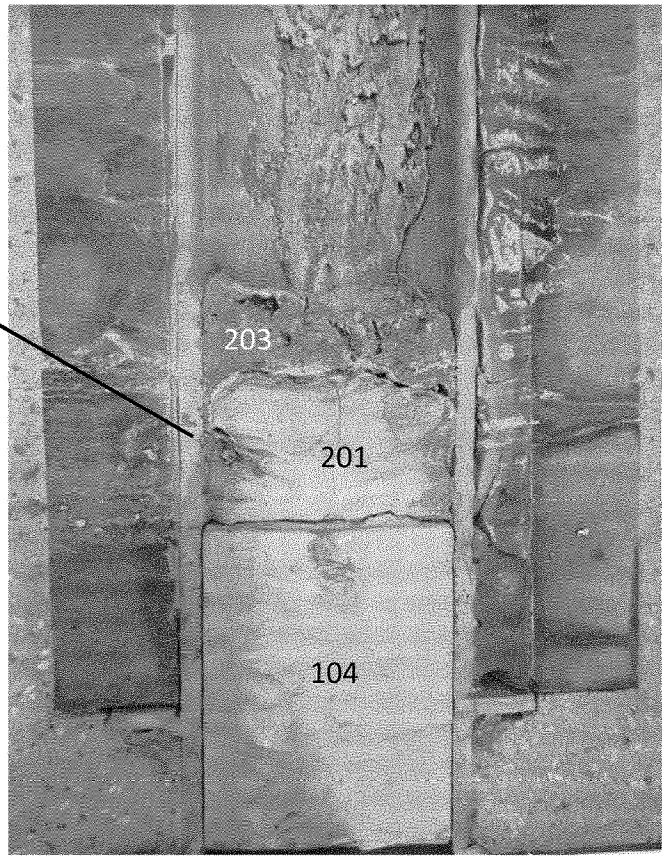

FIGS. 13*a*) and 13*b*) show a photograph of the resulting barrier (13*a*)) and the destroyed top of the test rig (13*b*)) in a failed test.

VERIFICATION OF THE INVENTION

The invention will be described in further detail by way of verification tests.

Experiment 1

A series of verification tests are made in a pilot-scale. Each test applied a cylindrical test tool constructed as illustrated in FIG. 7. The figure is a cut view seen from the side.

The test tool was prepared by cementing a cylindrically shaped rock (101) of outer diameter of approx. 20 cm and length of approx. 0.5 to 1.0 meter into a cylindrical concrete block (100) of outer diameter of approx. 40 cm and a height of 1 m. The rock should preferably have comparable physical and chemical properties with typical rock formations at actual locations for forming a well barrier. In these tests, the rock was commercially available slate from Oppdal, Norway.

A centre bore of inner diameter of 108 and coaxial with the rotational symmetry axis of the cylindrical body mm was made to go through the cylindrical rock cemented in concrete. Then a steel tube (102) of outer diameter of 88.9 mm was aligned coaxially into the centre bore and the gap between the bore wall and the outer surface of the steel tube was filled with Portland cement (103) to function as casing cement. The steel tube had an inner diameter of 76.3 mm (i.e. the steel tube had a thickness of 6.3 mm) and was approx. 2 m long such that it protrudes approx. 1 meter above the centre bore.

The steel tube (102) is provided with a bridge plug (104) at its lower part. The bridge plug may be made of cement or steel. A heat shield (105) of graphite was laid onto the bridge plug. Then a hollow cylindrically shaped thermite charge carrying tool (106) being closed in both ends was inserted into the steel tube and placed onto the bridge plug. The plugging tool was made of aluminium and had an outer diameter of 70.0 mm and a wall thickness of 3.0 mm, i.e. an inner diameter of 66.0 mm.

The inner space (107) was partly filled with 10 kg of a particulate bismuth oxide and particulate aluminium thermite reaction charge (108) where the bismuth oxide particles had a particle size of 1 to 3 mm and the aluminium particles has a particle size of 1 to 2 mm. The thermite reaction charge had a height of approx. 80 cm. An electric resistance igniter (109) was located inside thermite reaction charge. The inner space (107) was pressurised to a gas pressure of 235 bar by insertion of nitrogen gas before ignition. A pressure relief valve (110) set to release gas at pressures above 245 bar was applied in one of the tests.

Figure 8:
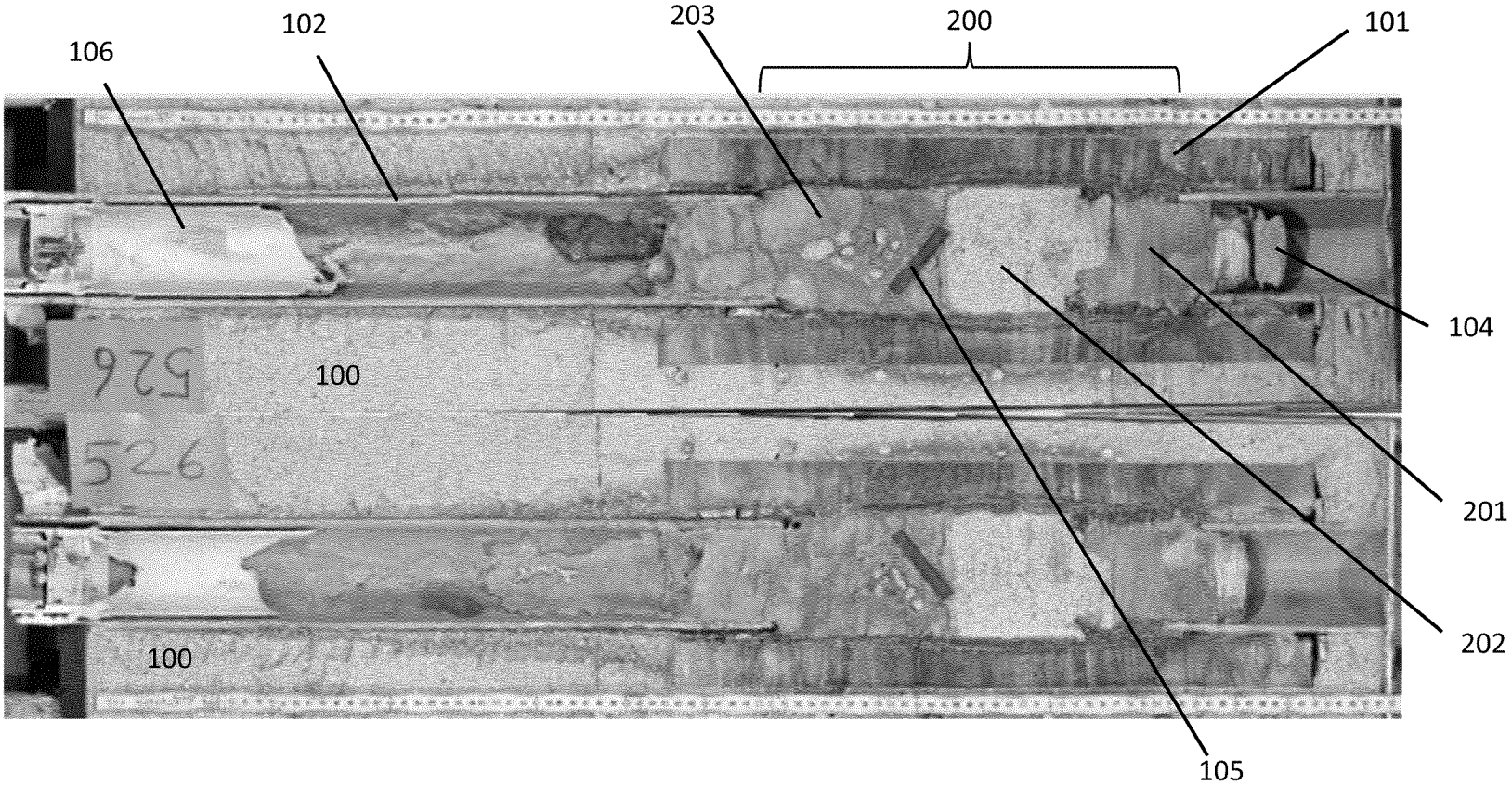

FIG. 8 shows a photograph of the test tool cut in half and laid side by side after firing the thermite reaction charge and cooling. In the photograph we see that the heat from the thermite reaction charge has completely melted a section, marked with reference number (200), of the casing (102) together with the casing cement and the resulting plug has "eaten its way" a distance into the slate (101) and thus obtained a rock-to-rock well barrier. The barrier is seen to consist of three phases, a lower phase of bismuth (201), an intermediate phase of steel/molten casing (202), and an upper phase of slag (203) of mostly alumina. All three phases are observed to have rock-to-rock contact. The photograph shows also a remaining part of the plugging tool (106) and the bridge plug (104). The graphite heat shield (105) did loose and float upwards into the slag phase in this test.

Figure 9:
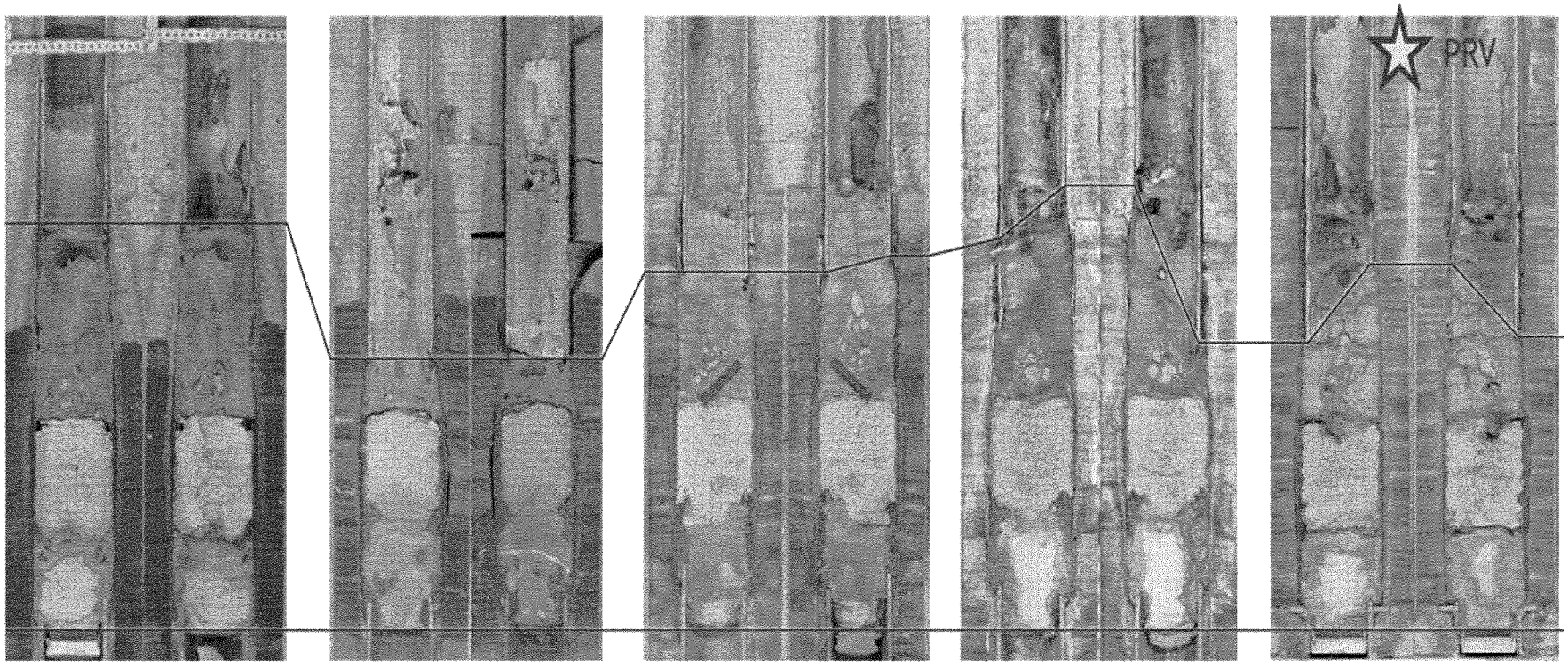

FIG. 9 is a photograph showing a comparison of the test result of the test shown in FIG. 8 (here shown as the middle test result) with 4 similar test results, all of them performed as described above. As seen on the photographs, the intended three-phase rock-to-rock well barrier is obtained in all samples.

Experiment 2

A series of similar tests as described in example 1 was performed with a thermite reaction charge comprising an interdigitated stack of alternating discs of bismuth oxide and aluminium discs. The bismuth oxide discs were made of bismuth oxide powder pressed to a density of at least 60% of theoretical maximum density and had a thickness of 25 mm and a diameter of 64 mm. The aluminium discs had a thickness of 7 mm and a diameter of 64 mm. The thermite charge consisted of 9.4 kg bismuth oxide and 1.1 kg of aluminium. The initial pressure was set to 1.5 MPa and it was applied a pressure relief valve which opened at a gas pressure of 1.51 MPa. Otherwise, the test conditions and tools applied were the same as for example 1.

Figure 10:
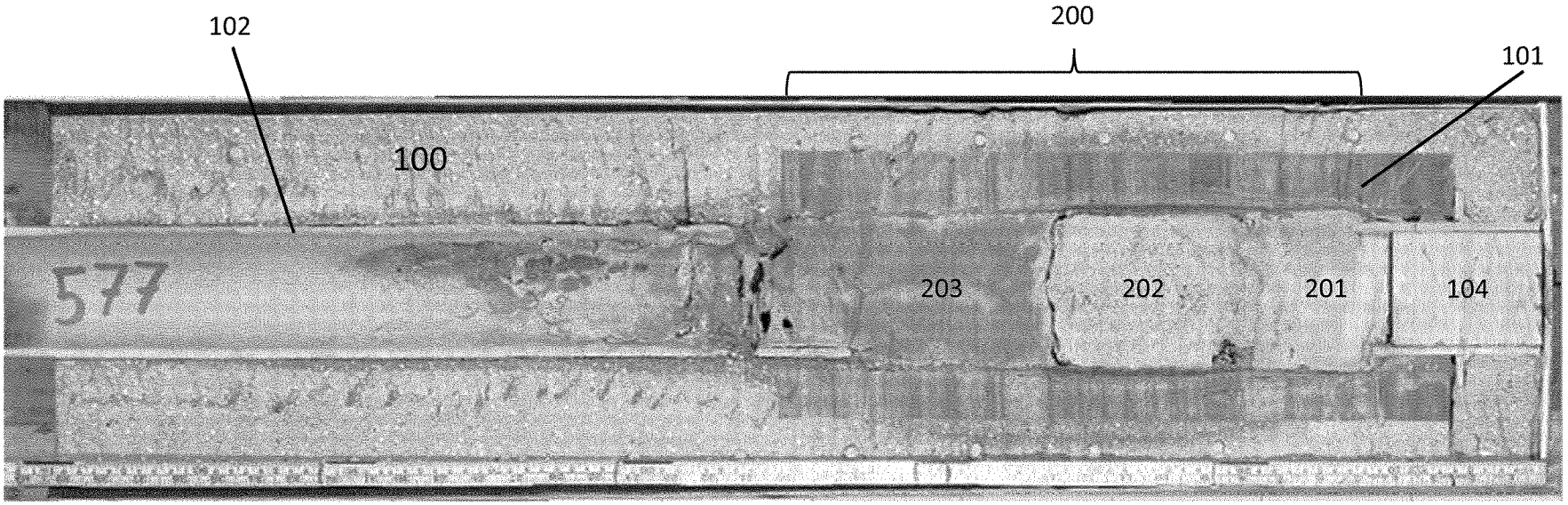

FIG. 10 is a photograph of the resulting three-phase rock-to-rock barrier. The photograph shows clearly the formation of a first well barrier (201) of bismuth metal, an intermediate well barrier (202) of steel, and third well barrier (203) of slag/aluminium oxide.

Figure 11:
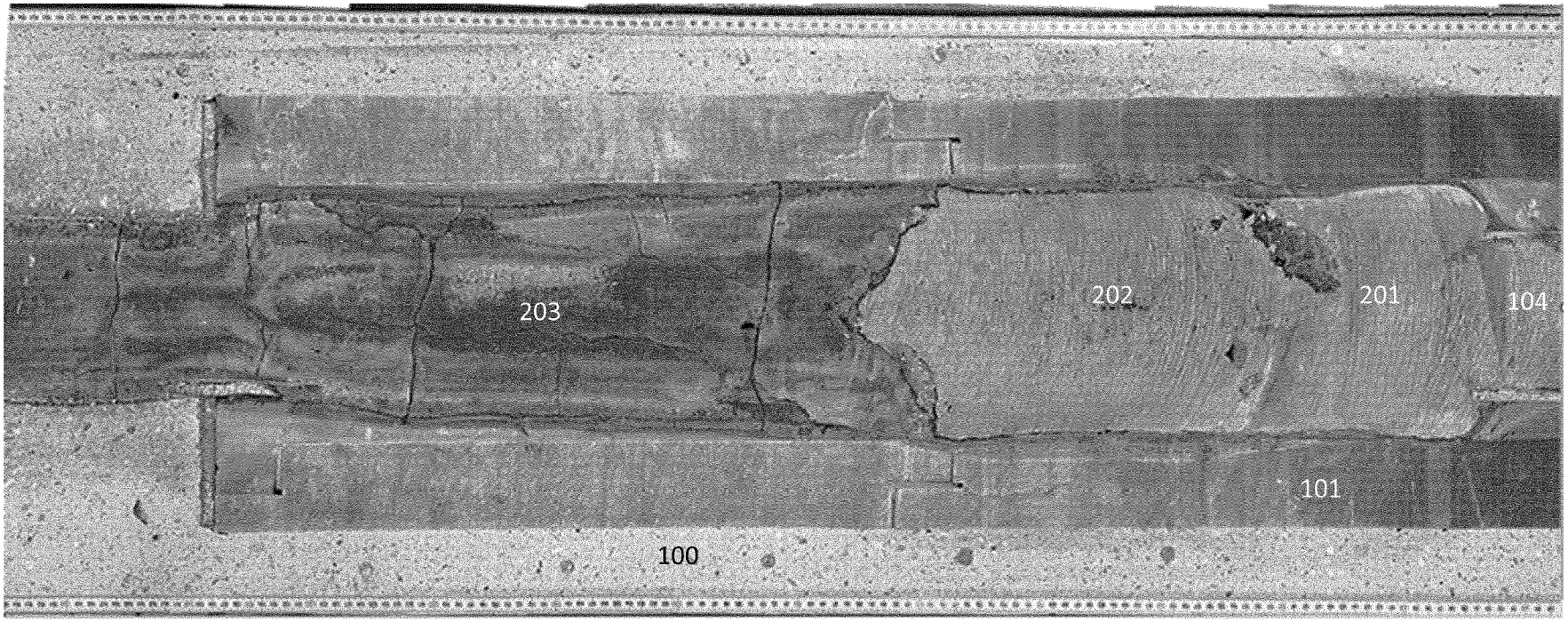

FIG. 11 is a photograph showing the resulting three-phase rock-to-rock barrier in a full-scale test with 90 kg of thermite comprising an interdigitated stack of alternating discs of bismuth oxide and aluminium discs. The bismuth oxide discs were made of bismuth oxide powder pressed to a density of at least 60% of theoretical maximum density and had a thickness of 25 mm and a diameter of 99 mm. The aluminium discs had a thickness of 7 mm and a diameter of 99 mm. The thermite charge consisted of 80 kg bismuth oxide and 10 kg of aluminium. The initial pressure was set to 15 MPa and it was applied a pressure relief valve which opened at a gas pressure of 15.1 MPa.

The test tool was similar to the test tool of the tests described in example 1, except for having larger dimensions. The length of the test tool was 2 m, the Oppdal slate block was approx. 1.8 meters long and had a diameter of 320 mm and the centre bore has an inner diameter of 220 mm. The casing had an outer diameter of 140 mm and an inner diameter of 122 mm. The thermite charge carrying tool was made of aluminium and had an outer diameter of 110 mm and a wall thickness of 5 mm, i.e. an inner diameter of 100 mm.

As is visible macroscopically in the photograph, the lowermost phase is Bismuth, that has a clean (tight) boundary with the steel, and then the dark, more voluminous oxide phase above that. From top to bottom the barrier is 1570 mm in height. As can also be seen, the casing pipe is melted away both within the barrier interval, but also significant parts of the casing pipe are melted away for a further 500 mm over the top of the barrier.

Comparison Tests

A series of small-scale tests with 600 to 800 g thermite charges were made in a test tool pressurised to 1.5 MPa. The test tool is cylindrical and around 420 mm tall and 220 in outer diameter. Inner chamber is approximately 210 mm in height and 160 mm diameter (4.2 litres). A crucible composed of $Al_2O_3$ is loaded into the chamber. The crucible has an inner volume for the thermite of around 140 mm height and 70 mm diameter. When the crucible is loaded with thermite there is approximately a litre or so of free volume in the test cell. There is one pressure sensor and several temperature sensors at various locations in the cell. The cell is pressurized with $N_2$ gas, and the thermite is ignited by the use of a primer in the form of a small capsule of thermite that is initiated using electricity.

The first test applied a thermite charge of particulate bismuth oxide and aluminium of particle size of 50 micron, the second test applied a thermite charge of particulate tin oxide and aluminium of particle size of 50 micron, the third test applied a thermite charge of particulate bismuth oxide and magnesium with particle sizes of 1-2 mm, the fourth test applied a thermite charge of particulate bismuth oxide and aluminium of particle size of 2 mm, and the fifth test applied a thermite charge of 25 mm thick discs of powdered bismuth oxide pressed to at least 60% of theoretical maximum density and 7 mm thick aluminium discs.

FIG. 12*a*) show a diagram illustrating measured pressures in the test tool as a function of time. The first test (curve marked "BiOx+Al (50 micron)") show a very rapid pressure increase comparable to an explosion from 1.5 to about 3.2 MPa in less than a second. The second test (curve marked "SnOx+Al (50 micron)") also show a very rapid pressure increase from 1.5 to about 2.6 MPa in less than a second. The third test (curve marked "BiOx+Mg based fuel Al (1-2 mm)") does also rise rapidly after a few tenths of a second delay to about 2.5 MPa. The fourth and fifth tests, (curve marked "2 mm Granular" and "7 mm disc", respectively) applied a thermite charge comparable to the thermite charges applied in experiment 1 and 2. As seen in FIG. 12*a*), these thermite charges created a significantly slower and more controlled pressure build-up.

FIG. 12*b*) is a diagram displaying measured pressure build-up given as the pressure gradient in bar/s for a series of five small-scale tests with 600 to 800 g thermite charges applying a particulate bismuth oxide of particle size 1-3 mm and particulate aluminium of various particle sizes. The curve marked "A" shows the measured pressure gradient with aluminium particles of 0.05 mm, the curve marked "B" shows the measured pressure gradient with aluminium particles of 0.125 to 1 mm, the curve marked "C" shows the measured pressure gradient with aluminium particles of 0.5 to 1.5 mm, the curve marked "D" shows the measured pressure gradient with aluminium particles of 1 to 2 mm, and the curve marked "E" shows the measured pressure gradient with aluminium particles of 2 mm. As expected, the reaction kinetics increased significantly with lesser particle sizes of the aluminium fuel metal.

Another result in the small-scale tests was that if the pressure was reduced before ignition, that the gaseousness of the thermite became more and more, until eventually the safety burst disc on the pressure cell actually punctured due to getting hot condensed Bi gas on it. It was necessary to contain the pressure in the test tool, then eventually the majority of the thermite products condense and accumulate into density separated solids.

FIG. 13*a*) is a photograph showing the resulting barrier formed in a half-scale test with approx. 10 kg of the same thermite charge of particulate bismuth oxide and magnesium with particle sizes of 1-2 mm applied in the small-scale test shown in FIG. 12*a*). The test was performed in a similar test tool as applied in experiment 1 with an initial pressurisation to 1.5 MPa. As seen from photograph 13*a*), the test failed by not being able to melt the casing (102) such that the well barrier did not become a rock-to-rock barrier and consisted of only two phases, a lower bismuth phase (201) positioned onto the bridge plug (104) and a slag phase (203) mainly consisting of magnesium oxide. The photograph also indicate that slag has been violently hurled upwards in the casing. This is confirmed by the photograph in FIG. 13*b*) which shows the top of the test setup after the test having an accumulation of granular material which turned out to be thermite reaction products. I.e., a part of the plug forming material was blown away such that the thermite products accumulated only a few cm in the base of the test setup, and no casing was melted, proving that loss of control of the thermite reaction (too high reaction kinetics) is not likely to yield a successful barrier.

The above results of the "BiOx+Mg based fuel (1-2 mm)" thermite charge does not form the intended three-phase rock-to-rock barrier while the "2 mm granular" thermite mixture does, indicate that the limit for how fast the thermite reaction can proceed (and build up pressure) is somewhere between the reaction velocity/-pressure gradient of the 1-2 mm particulate bismuth oxide and magnesium thermite and the 2 mm bismuth oxide and aluminium thermite.

Thus, in summary, these test results (and other not displayed here) indicate that a reaction velocity corresponding to a pressure gradient of less than 5 MPa/s provide a controllable thermite able to form the intended three-phased rock-to-rock well barrier. This corresponds to a reaction rate giving a reaction time for a thermite reaction charge of 30 to 100 kg of from 8 to 15 seconds from initialisation of the thermite reaction charge to at least 90%, see FIG. 6.

REFERENCES

1 World Oil Magazine February 2020, retrievable on the internet: http://www.worldoil.com/magazine/2020/february-2020/special-focus/special-focus-2020-forecast-international-drilling-and-production 2 Khalifeh, M. and Saasen, A., "Introduction to Permanent Plug and Abandonment of Wells", Springer Open, 2020, https://doi.org/10.1007/978-3-030-39970-2, ISBN 978-3-030-39969-6. http://creativecommons.org/licenses/by/4.0/3

3 Wang, L. et al., "The behaviour of nanothermite reaction based on $Bi_2O_3$/Al", Journal of Applied Physics 110, 074311 (2011); https://doi.org/10.1063/1.3650262 https://aip.scitation.org/doi/abs/10.1063/1.3650262?ver=pdfcov&journalCode=jap

The invention claimed is:

1. A thermite reaction charge, comprising bismuth oxide $Bi_2O_3$ and a fuel metal comprising aluminium, wherein the thermite reaction charge is adapted to react at a reaction rate giving a reaction time of from 8 to 15 seconds for a thermite reaction charge of 30 to 100 kg from initialisation of the thermite reaction charge to until at least 90% of the thermite reaction charge is reacted, and the thermite reaction charge comprises a monolithic planar solid disc of bismuth oxide, and a fuel metal comprising at least one monolithic solid object of aluminium.

2. The thermite reaction charge according to claim 1, wherein a particle size of the bismuth oxide used to produce the monolithic planar solid disc of bismuth oxide is in a range of from 1 to 3 mm and a particle size of the aluminium used to produce the monolithic solid object of aluminium is in a range of from 1 to 2 mm.

3. The thermite reaction charge according to claim 1, wherein the thermite reaction charge comprises:

the monolithic planar solid disc of bismuth oxide, where:

the monolithic planar solid disc of bismuth oxide is pressed to a density in a range of from 50 to 99% of a theoretical maximum density of 8.9 g/cm$^3$, and the monolithic planar solid disc of bismuth oxide has a thickness of from 0.5 to 20 cm, and an outer diameter adapted to fit into an inner chamber of a thermite charge carrying tool, and the fuel metal comprising the at least one monolithic solid object of aluminium.

4. The thermite reaction charge according to claim 1, wherein the thermite reaction charge comprises:

a set of at least two of the monolithic planar solid discs of bismuth oxide, wherein the fuel metal comprises a set of at least two monolithic solid objects of aluminium, each shaped into a planar solid disc having an outer diameter being the same as the monolithic planar solid discs of bismuth oxide, wherein the monolithic planar solid discs of bismuth oxide and the monolithic solid objects of aluminium are stacked in a stack of alternating bismuth oxide and aluminium discs.

5. The thermite reaction charge according to claim 1, wherein the thermite reaction charge comprises:

a set of at least two of the monolithic planar solid discs of bismuth oxide, wherein the fuel metal comprises a set of at least two of the monolithic solid objects of aluminium, each shaped into a planar solid disc having an outer diameter being the same as the monolithic solid discs of bismuth oxide, and wherein the monolithic planar solid discs of bismuth oxide and the monolithic solid objects of aluminium are stacked in a stack of alternating bismuth oxide and aluminium discs, wherein a thickness of the monolithic solid objects of aluminium is adapted to give a stoichiometric ratio of Bi:Al based on either:

a total content of bismuth oxide and aluminium of the thermite reaction charge, or:

a content of bismuth oxide of the thermite reaction charge and a content of aluminium of the thermite reaction charge and a content of aluminium of a thermite charge carrying tool applied to insert the thermite reaction charge into a well.

6. The thermite reaction charge according to claim 1, wherein the thermite reaction charge comprises:

a set of at least two of the monolithic planar solid discs of bismuth oxide, where each has a through-going centre channel located at and in parallel with a rotational symmetry axis of the monolithic planar solid disc of bismuth oxide, and the fuel metal, wherein the fuel metal comprises one monolithic solid object of aluminium shaped into a rod adapted to fit into and fill the through-going centre channel of the monolithic planar solid discs of bismuth oxide, wherein the set of at least two of the monolithic planar solid discs of bismuth oxide are thread onto the rod, and an inner diameter of the through-going centre channel and an outer diameter of the aluminium rod are both adapted so that when the aluminium rod fills the through-going centre channel, a total amount of aluminium and bismuth present in the termite reaction charge corresponds to a stoichiometric ratio of Bi:Al.

7. The thermite reaction charge according to claim 1, wherein the fuel metal of the thermite reaction charge comprises Al with Ca, Mg and Si in an amount to give a fuel mixture of Al, Ca, Mg and Si containing from 1 to 32 wt % Mg and from 1 to 68 wt % $CaSi_2$, based on a total weight of Al, Mg, Si and Ca present in the thermite charge.

8. The thermite reaction charge according to claim 1, wherein the thermite reaction charge further comprises CaO and/or SiO2 in an amount adapted to provide, after reacting the thermite charge, a slag phase having a melting point between 1800 and 1200° C.

9. A method of sealing a well with a rock-to-rock cross-sectional well barrier, where the well comprises a downhole completion comprising at least a casing, wherein the method comprises:

installing a heat resistant bridge plug in an innermost casing at a location where the seal is to be formed, placing a thermite charge carrying tool on top of the heat resistant bridge plug, wherein the thermite charge carrying tool comprises an inner chamber filled with a thermite reaction charge and an igniter, and igniting the thermite reaction charge, characterised in that:

the method further comprises applying a thermite reaction charge according to claim 1, wherein the thermite reaction charge is pressurised to an in-situ pressure of at least 5 MPa.

10. The method according to claim 9, wherein, the in-situ pressure is at least 6 MPa.

11. The method according to claim 9, wherein the in-situ pressure is obtained by, prior to ignition of the thermite reaction charge, injection of gas to the inner chamber of the thermite charge carrying tool.

12. The method according to claim 9, wherein, the in-situ pressure is obtained by either:

injecting a gas into the inner chamber of the thermite charge carrying tool prior to ignition of the thermite reaction charge, or:

pressing the thermite reaction charge in the inner chamber of the thermite charge carrying tool by a piston prior to ignition of the thermite reaction charge, or:

using gas from the initial thermite reaction phase to increase the pressure.

13. A thermite charge carrying tool, where the thermite charge carrying tool comprises a cylindrically shaped container having a bottom, a side-wall, a top, a cylindrical inner chamber, and a cable interface arranged on the top, and an igniter adapted to ignite the thermite reaction charge, characterised in that the thermite charge carrying tool further comprises:

a thermite reaction charge according to claim 1 being arranged within the cylindrical inner chamber.

14. The thermite charge carrying tool according to claim 13, wherein the thermite charge carrying tool further comprises a piston arranged within the cylindrical inner chamber adapted to press against the thermite reaction charge therein.

15. The thermite charge carrying tool according to claim 14, wherein the piston is actuated by the ambient hydrostatic pressure in the well.

16. The thermite charge carrying tool according to claim 14, wherein the thermite charge carrying tool further comprises one or more valves enabling injection of gas to the cylindrical inner chamber for obtaining and maintaining a pressure ($p_i$) within the cylindrical inner chamber of at least 5 MPa, and wherein the check and release valve is further adapted to open and release gas from the cylindrical inner chamber if the pressure (p) inside the cylindrical inner chamber becomes; $p>p_i+\Delta p$, where $\Delta p$ is 0.1 MPa.

17. The thermite reaction charge according to claim 1, wherein the thermite reaction charge is adapted to react at a reaction rate giving a reaction time of from 9 to 14 seconds.

18. The thermite reaction charge according to claim 1, wherein the thermite reaction charge is adapted to react at a reaction rate giving a reaction time of from 10 to 13 seconds.

19. The thermite reaction charge according to claim 1, wherein the a particle size of the bismuth oxide used to produce the monolithic planar solid disc of bismuth oxide is in a range of from 1 mm to 7 mm and a particle size of the aluminium used to produce the monolithic solid object of aluminium is in a range of from 1 mm to 7 mm.

20. The thermite reaction charge according to claim 1, wherein a particle size of the bismuth oxide used to produce the monolithic planar solid disc of bismuth oxide is in a range of from 1 mm to 5 mm and a particle size of the aluminium used to produce the monolithic solid object of aluminium is in a range of from 1 mm to 5 mm.

21. The thermite reaction charge according to claim 1, wherein a particle size of the bismuth oxide used to produce the monolithic planar solid disc of bismuth oxide is in a range of from 1 mm to 3 mm and a particle size of the aluminium used to produce the monolithic solid object of aluminium is in a range of from 1 mm to 3 mm.

22. The thermite reaction charge according to claim 1, wherein the thermite reaction charge comprises:

the monolithic planar solid disc of bismuth oxide, where:

the monolithic planar solid disc of bismuth oxide is pressed to a density in a range of from 70 to 80% of a theoretical maximum density of 8.9 g/cm$^3$, and the monolithic planar solid disc of bismuth oxide has a thickness of from 3 to 10 cm, and an outer diameter adapted to fit into an inner chamber of a thermite charge carrying tool, and the fuel metal comprising the at least one monolithic solid object of aluminium.

23. The thermite reaction charge according to claim 1, wherein the fuel metal of the thermite reaction charge comprises Al with Ca, Mg and Si in an amount to give a fuel mixture of Al, Ca, Mg and Si containing from 5 to 32 wt % Mg and from 10 to 68 wt % $CaSi_2$, based on a total weight of Al, Mg, Si and Ca present in the thermite charge.

24. The thermite reaction charge according to claim 1, wherein the fuel metal of the thermite reaction charge comprises Al with Ca, Mg and Si in an amount to give a fuel mixture of Al, Ca, Mg and Si containing from 10 to 32 wt % Mg and from 20 to 68 wt % $CaSi_2$, based on a total weight of Al, Mg, Si and Ca present in the thermite charge.

25. The thermite reaction charge according to claim 1, wherein the fuel metal of the thermite reaction charge comprises Al with Ca, Mg and Si in an amount to give a fuel mixture of Al, Ca, Mg and Si containing from 15 to 32 wt % Mg and from 30 to 68 wt % $CaSi_2$, based on a total weight of Al, Mg, Si and Ca present in the thermite charge.

* * * * *